US010215514B2

(12) United States Patent
Hochstrate et al.

(10) Patent No.: US 10,215,514 B2
(45) Date of Patent: Feb. 26, 2019

(54) FIREARM HAVING A HYBRID INDIRECT GAS OPERATING SYSTEM

(71) Applicant: Colt's Manufacturing IP Holding Company LLC, West Hartford, CT (US)

(72) Inventors: Paul Hochstrate, Plantsville, CT (US); Michael Josey, Farmington, CT (US); Kevin Audibert, Wolcott, CT (US)

(73) Assignee: COLT'S MANUFACTURING IP HOLDING COMPANY LLC, West Hartford, CT (US)

( * ) Notice: Subject to any disclaimer, the term of this patent is extended or adjusted under 35 U.S.C. 154(b) by 0 days.

(21) Appl. No.: 14/840,747

(22) Filed: Aug. 31, 2015

(65) Prior Publication Data

US 2016/0187084 A1 Jun. 30, 2016

Related U.S. Application Data

(63) Continuation of application No. 12/559,047, filed on Sep. 14, 2009, now Pat. No. 9,243,856.

(60) Provisional application No. 61/096,697, filed on Sep. 12, 2008.

(51) Int. Cl.
*F41A 5/18* (2006.01)
*F41A 5/24* (2006.01)

(52) U.S. Cl.
CPC . *F41A 5/18* (2013.01); *F41A 5/24* (2013.01)

(58) Field of Classification Search
CPC ..... F41A 5/18
See application file for complete search history.

(56) References Cited

U.S. PATENT DOCUMENTS

| | | | | | |
|---|---|---|---|---|---|
| 698,107 | A * | 4/1902 | Knight | F41A 19/31 | 89/1.1 |
| 3,246,567 | A * | 4/1966 | Miller | F41A 5/18 | 89/191.01 |
| 3,618,457 | A * | 11/1971 | Miller | F41A 5/18 | 89/1.4 |
| 2006/0053673 | A1* | 3/2006 | Murello | F41C 27/06 | 42/71.01 |
| 2006/0065112 | A1* | 3/2006 | Kuczynko | F41A 5/28 | 89/193 |
| 2007/0199435 | A1* | 8/2007 | Hochstrate | F41A 3/66 | 89/191.02 |
| 2011/0023700 | A1* | 2/2011 | Herring | F41A 5/18 | 89/193 |

* cited by examiner

*Primary Examiner* — Reginald Tillman, Jr.
(74) *Attorney, Agent, or Firm* — Cantor Colburn LLP

(57) ABSTRACT

An automatic or semi-automatic rifle. The rifle has a receiver and a bolt having a striking surface, the bolt enclosed within the receiver. A barrel has a bore, the barrel coupled to the receiver. An indirect gas operating system has a cylinder and a piston, the indirect gas operating system mounted with a mounting structure substantially independent of the barrel. The cylinder is in communication with the bore, and the piston is fitted to the cylinder and disposed for striking the striking surface and displacing the bolt assembly.

8 Claims, 42 Drawing Sheets

FIREARM HAVING A HYBRID INDIRECT GAS OPERATING SYSTEM

CROSS REFERENCE TO RELATED APPLICATIONS

This application is a continuation of U.S. patent application Ser. No. 12/559,047, filed Sep. 14, 2009, which claims the benefit of U.S. Provisional Application No. 61/096,697 filed on Sep. 12, 2008 the entire contents each of which are incorporated herein by reference thereto.

BACKGROUND

1. Field of the Disclosed Embodiments

The disclosed embodiments relate to firearms and, more particularly, to a firearm having a hybrid indirect gas operating system.

2. Brief Description of Earlier Developments

There are conventional semi-automatic or automatic firearms that are gas operated via an operating rod in the case of an indirect gas operating system. Such systems rely on a piston and operating rod with the piston actuated by gas from the barrel of the firearm. A problem arises when the cylinder is coupled directly to the barrel due to barrel deflection. As such, there is a desire to be able to eliminate interaction between the cylinder and the barrel.

SUMMARY OF THE INVENTION

In accordance with one exemplary embodiment, an automatic or semi-automatic rifle is provided. The rifle has a receiver and a bolt having a striking surface, the bolt housed within the receiver. A barrel is provided having a bore, the barrel coupled to the receiver. An indirect gas operating system is provided having a cylinder and a piston, the indirect gas operating system mounted with a mounting structure connected to the receiver so that the indirect gas operating system depends from the receiver and is substantially independent of the barrel. The cylinder is in communication with the bore, and the piston is fitted to the cylinder and disposed for striking the striking surface and displacing the bolt assembly.

In accordance with another exemplary embodiment, an automatic or semi-automatic rifle is provided. The rifle has a receiver and a bolt having a striking surface, the bolt housed within the receiver. A barrel is provided having a bore, the barrel coupled to the receiver. An indirect gas operating system is provided having a cylinder and a piston, the indirect gas operating system coupled to the receiver. The indirect gas operating system and the barrel are separately and independently mounted to the receiver so that the indirect gas operating system and the barrel are structurally substantially independent from each other, and the cylinder is in communication with the bore, and the piston is fitted to the cylinder and disposed for striking the striking surface and displacing the bolt assembly.

In accordance with another exemplary embodiment, an automatic or semi-automatic rifle is provided. The rifle has a receiver and a bolt having a striking surface, the bolt housed within the receiver. A barrel is provided having a bore, the barrel coupled to the receiver. An indirect gas operating system is provided having a cylinder and a piston, the indirect gas operating system coupled to the receiver independent of the barrel. The cylinder is in communication with the bore through a gas feed system, the gas feed system releasing the indirect gas operating system from barrel motion and displacement relative to the receiver, and the piston is fitted to the cylinder and disposed for striking the striking surface and displacing the bolt assembly.

BRIEF DESCRIPTION OF THE DRAWINGS

The foregoing aspects and other features of the exemplary embodiments are explained in the following description, taken in connection with the accompanying drawings, wherein.

DETAILED DESCRIPTION

Figure 1:
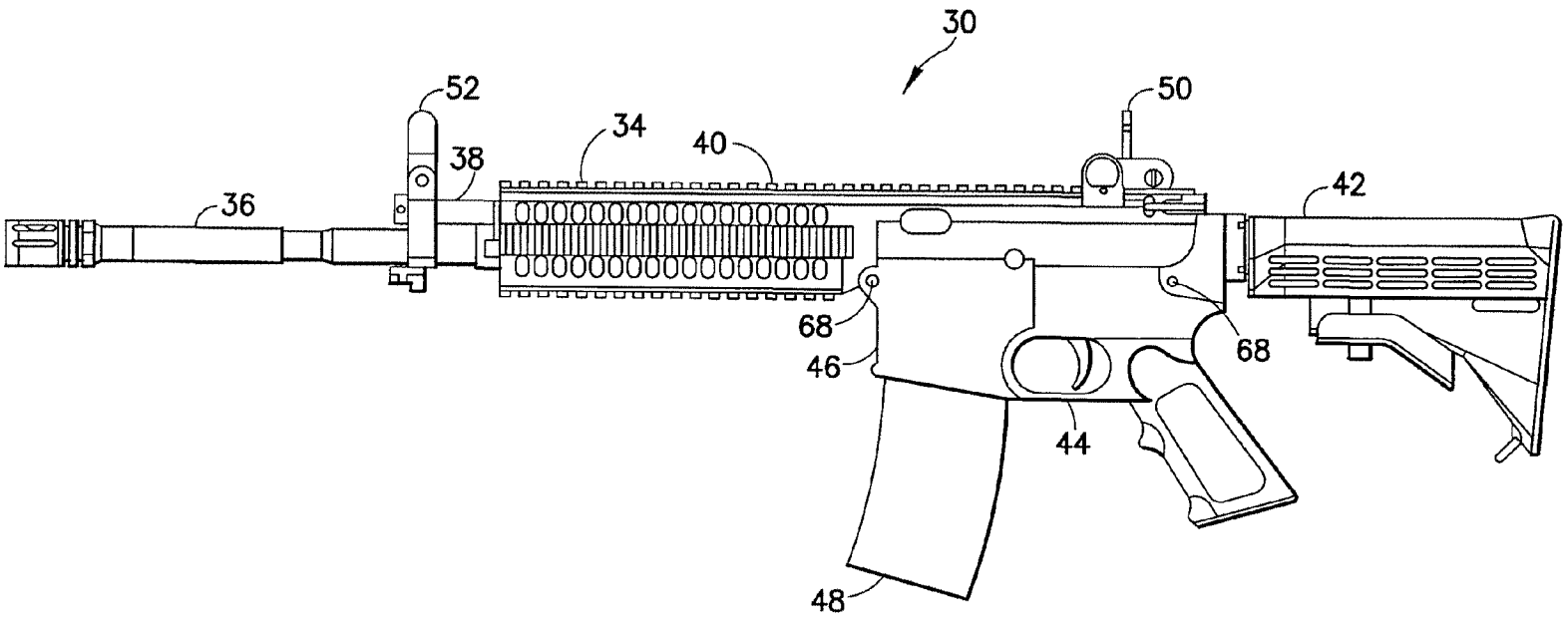
FIG. 1 is a side view of an automatic firearm incorporating features in accordance with an exemplary embodiment.

Referring to FIG. 1, there is shown, a side elevation view of an automatic firearm 30 capable of automatic or semiautomatic fire incorporating features in accordance with an exemplary embodiment of the present invention. Although the present invention will be described with reference to the embodiments shown in the drawings, it should be understood that the present invention can be embodied in many alternate forms of embodiments. In addition, any suitable size, shape or type of elements or materials could be used.

Firearm 30 may be indirect gas operated, like examples, such as the M-4™ or M-16, similar commercial variants thereof and may have features as disclosed in U.S. patent application Ser. No. 11/231,063 filed Sep. 19, 2005, U.S. patent application Ser. No. 11/352,036 filed Feb. 9, 2006 or U.S. patent Application No. 60/772,494 filed Feb. 9, 2006 all of which are hereby incorporated herein by reference in their entirety. Firearm 30 is illustrated as generally having a black rifle type configuration, the black rifle type configuration being the family of rifles developed by Eugene Stoner, for example, such as an M4™ or M16 automatic firearm configuration. However, the features of the disclosed embodiments, as will be described below, are equally applicable to any desired type of automatic firearm. Firearm 30 may have features such as disclosed in U.S. patent application Ser. No. 11/672,189 filed Feb. 7, 2007, and U.S. patent application Ser. No. 11/869,676 filed Oct. 9, 2007, all of which are hereby incorporated by reference herein in their entirety. Firearm 30 may have operational features such as disclosed in U.S. Pat. Nos. 5,726,377, 5,760,328, 4,658,702, 4,433,610, U.S. Non Provisional patent application Ser. No. 10/836,443 filed Apr. 30, 2004, and U.S. Provisional Patent Application 60/564,895 filed Apr. 23, 2004, all of which are hereby incorporated by reference herein in their entirety. The firearm 30 and its sections described in greater detail below is merely exemplary. In alternate embodiments the firearm 30 may have other sections, portions or systems. Firearm 30 may have an upper receiver section 34 a barrel 36, hybrid indirect gas operating system 38, and hand guard portion 40. Hand guard section 40 may have features such as disclosed in U.S. Pat. Nos. 4,663,875 and 4,536,982, both of which are hereby incorporated by reference herein in their entirety. Hand guard section 40 of upper receiver section 34 may be configured to support such rails as a "Picatiny Rail" configuration as described in Military Standard 1913, which is hereby incorporated by reference herein in its entirety. The rails may be made from any suitable material such as hard coat anodized aluminum as an example. Rear sight assembly 50 is provided and mounted to upper receiver section 34. Firearm 30 may incorporate stock 42, lower receiver section 44, magazine well 46, clip or magazine 48 and rear and front sights 50, 52. Upper receiver 34 having barrel 36, lower receiver 44 and magazine well 46 may be modular and configurable such that firearm 30 comprises a modular rifle design. Further, the hand guard, and accessory mounting rails thereon, may be integral with the upper receiver and the integral upper receiver, hand guard and mounting rails may be of unitary construction. In alternate embodiments, the upper receiver and hand guard may be separate.

Figure 2:
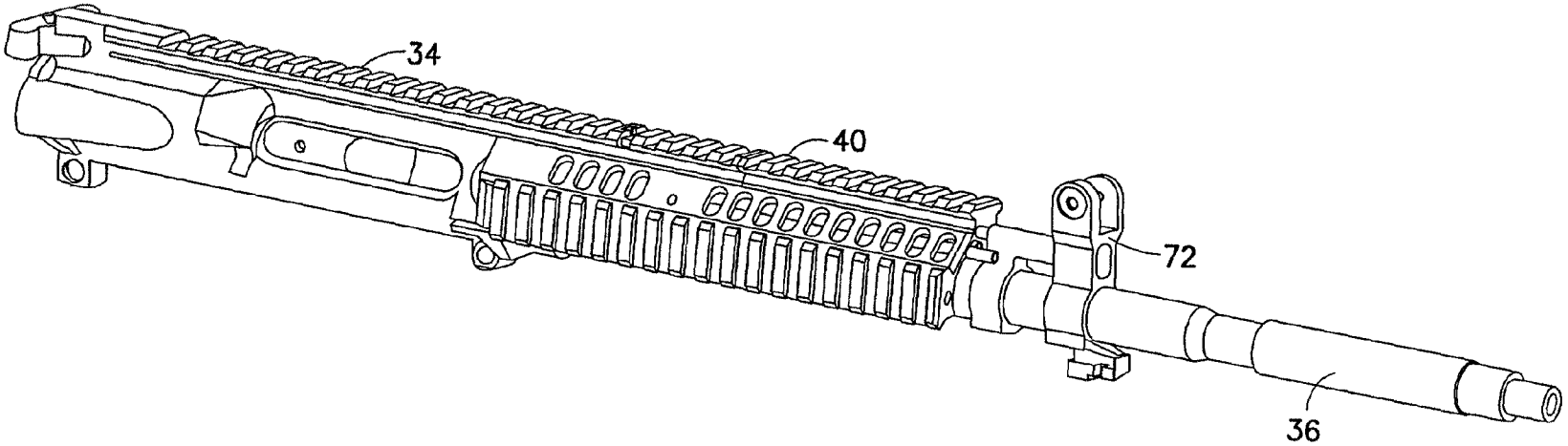
FIG. 2 is an isometric view of an upper receiver section of the firearm shown in FIG. 1.
Figure 3:
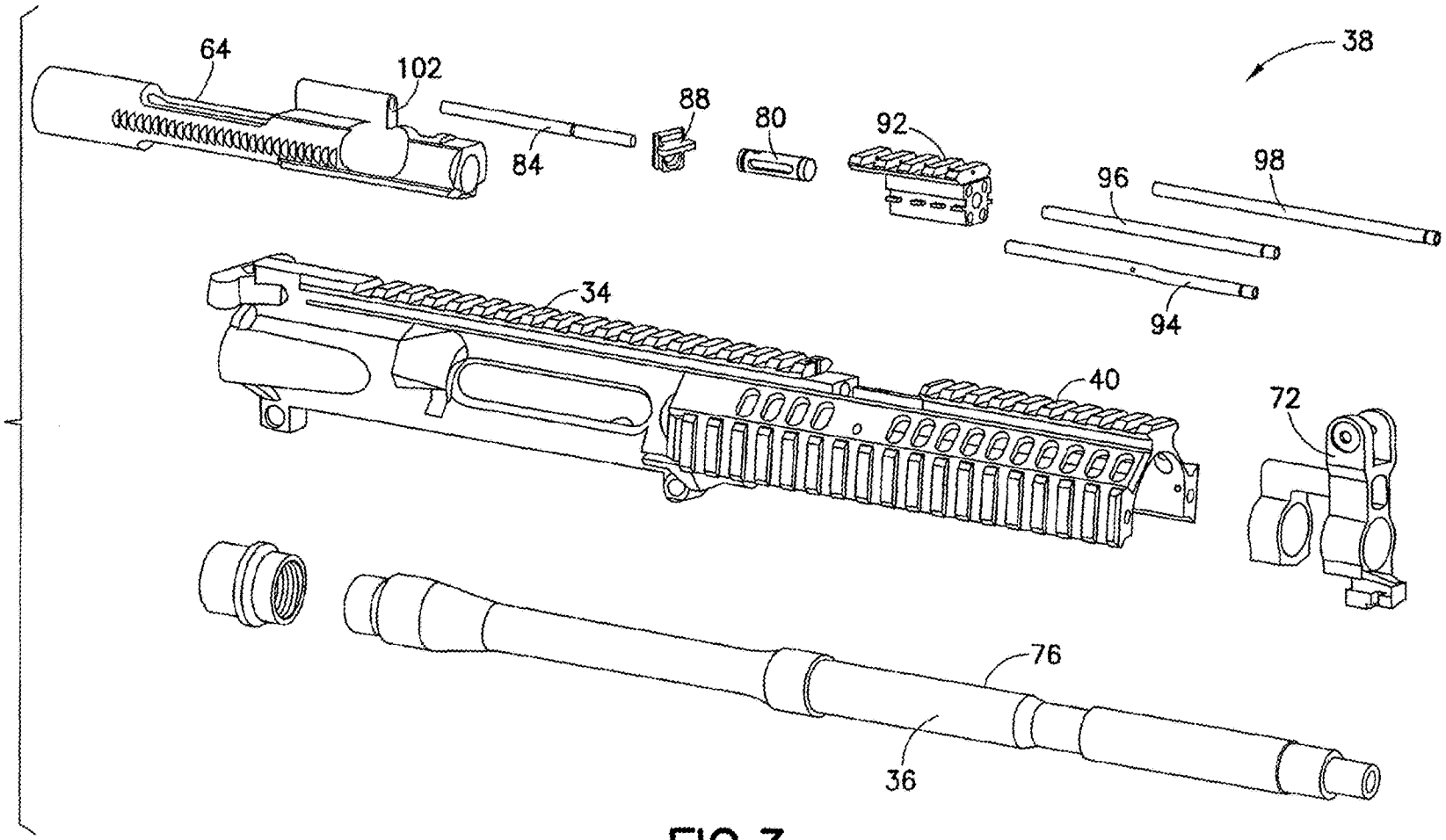
FIG. 3 is an exploded isometric view of the upper receiver section of the firearm shown in FIG. 1.
Figure 4:
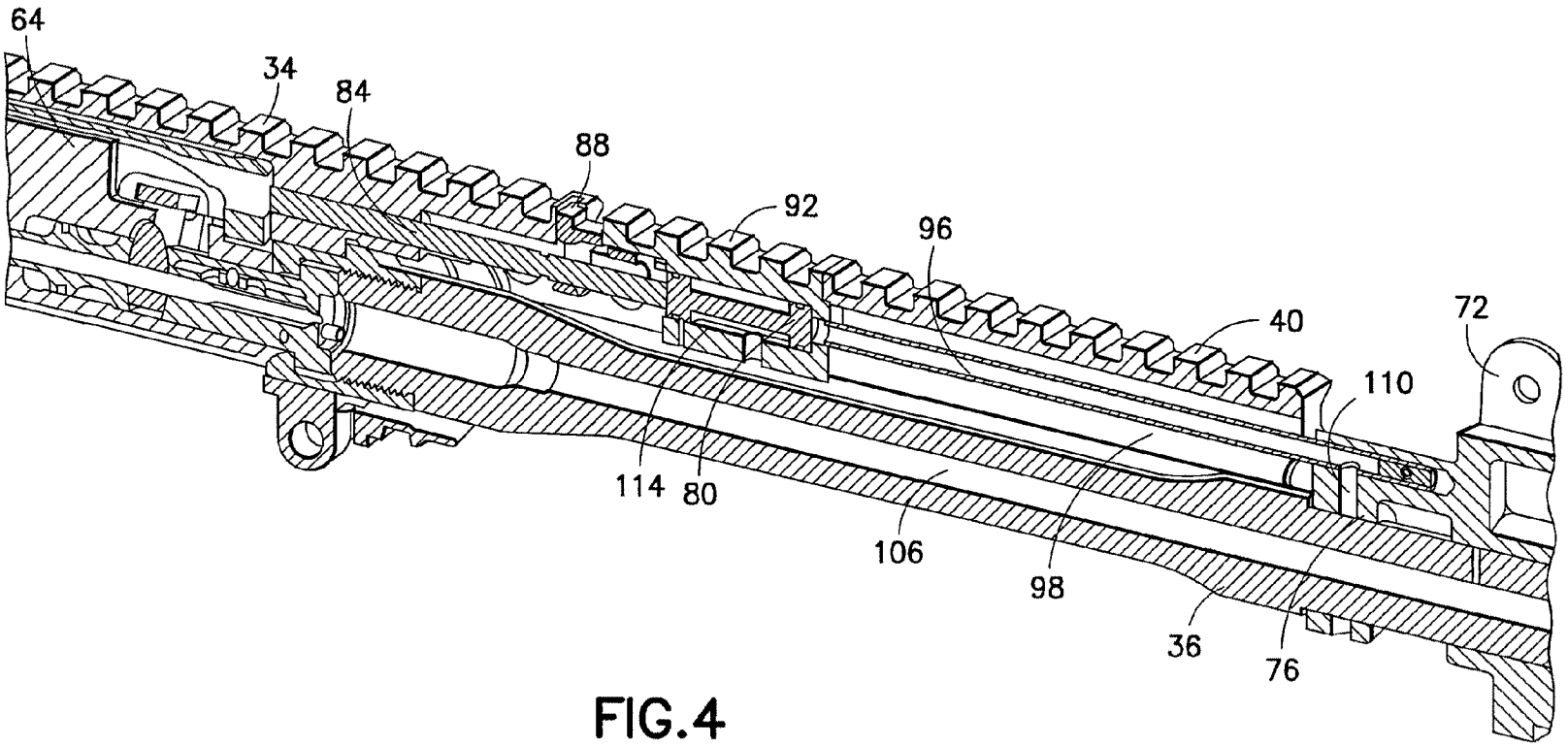
FIG. 4 is a section view of the upper receiver section of the firearm shown in FIG. 1.

Referring now to FIG. 2, there is shown an isometric view of an upper receiver section of the firearm shown in FIG. 1. Referring also to FIG. 3, there is shown an exploded isometric view of the upper receiver section of the firearm shown in FIG. 1. Referring also to FIG. 4, there is shown a section view of the upper receiver section of the firearm shown in FIG. 1. Firearm 30 has what may be referred to for description purposes as a hybrid indirect gas operating system 38 facilitating automatic or semi-automatic operation as will be described below. The indirect gas operating system may be adjustable, allowing the operator to vary cyclic rate as desired. In the exemplary embodiment, the hybrid indirect gas operating system may include a gas feed system, with a gas block and a gas tube feeding gas from the gas block towards the receiver (somewhat similar the arrangement of a conventional gas impingement operating system). The hybrid indirect gas operating system, may further include a cylinder and piston interposed between the gas tube and receiver with feed gas from the gas tube, as will be described in greater detail below, to operate the automatic or semiautomatic firearm. Hence, the operating system of the firearm may be referred to as hybrid indirect gas operating system.

Referring still to FIGS. 1-4, the system 38 has a gas block 72 fitted to barrel assembly 36 where barrel 36 has bore 106 with the gas block being in fluid communication with the bore through a port 76 in barrel 36. The gas block is in fluid communication with the bore through a corresponding port 110 disposed on a surface of the gas block facing the barrel. Cylinder housing 92 is in fluid communication with gas block via gas tube 96. Piston 80, striking or operating rod assembly 84, stop plate 88, cylinder housing 92 and gas tubes 94, 96, 98 are housed within the hand guard portion 40 of upper receiver 34. As will be described below, cylinder housing 92 is dependent from the upper receiver, for example mounted to the receiver or to the guard portion 40 of receiver 34 and structurally decoupled or independent from the barrel. In the exemplary embodiment the cylinder housing 92 may be removable from hand guard portion 40 for cleaning Cylinder housing 92 being mounted so that it is dependent from receiver 34 is thus fixed with receiver 34 and is isolated from deflection or movement of barrel 36 during firing. As such, cylinder housing 92 maintains parallel alignment with bolt carrier 64 (see FIG. 4). Here, the piston and operating rod module is independent of and decoupled from the barrel and mounted to the upper receiver shifted forward and away from the chamber. This avoids delivering heat into the loaded chamber. Decoupling from the barrel eliminates issues associated with a barrel mounted piston assembly such as heat deflection and barrel whip. Additionally, there is less concern of binding due to decoupling from the barrel. Piston 80 is fitted to the cylinder 114 within cylinder housing 92. The piston 80 is movably fitted to the cylinder housing 92. The striking or operating rod 84 may be joined at its front end, for example by a threaded connection or other suitable coupling, to the piston 80. In alternate embodiments, other suitable connections may be provided, for example a compliant connection. The coupling between piston and strike or operator rod 84 may be configured to allow coupling and uncoupling with the cylinder housing 92 joined to the receiver. In the exemplary embodiment, the cylinder housing 92 may have one or more exhaust orifices or ports formed in the front end of the housing 92 to interface with exhaust gas lines 94, 98. Although two ports are shown for example, any suitable number may be provided. In alternate embodiments, the port may be located on any suitable surface. In other alternate embodiments, the cylinder housing may have a common gas feed and exhaust port. A bolt carriage assembly 64 is provided within receiver 34. The bolt carriage assembly 64 has striking surface 102 cooperating with rod 84 of operating system 38. When a cartridge is fired, pressurized gas enters gas block 72, passes to the cylinder within cylinder housing (located remote from gas block 72) via gas tube 96, displaces piston 80 and causes striking rod 84 to strike striking surface 102 displacing bolt assembly 64. The striking rod 84 and striking surface 102 may disengage each other after the striking rod strikes the striking surface. A cyclic rate selector may be provided that interfaces with the pressurizing gas in the cylinder to vary the bolt carriage cycle rate during automatic operation of the firearm. A gas regulator to regulate feed gas flow to the remote cylinder housing, independent of system variances may be incorporated into the gas block or the cylinder housing or otherwise as will be described further below.

Figure 5:
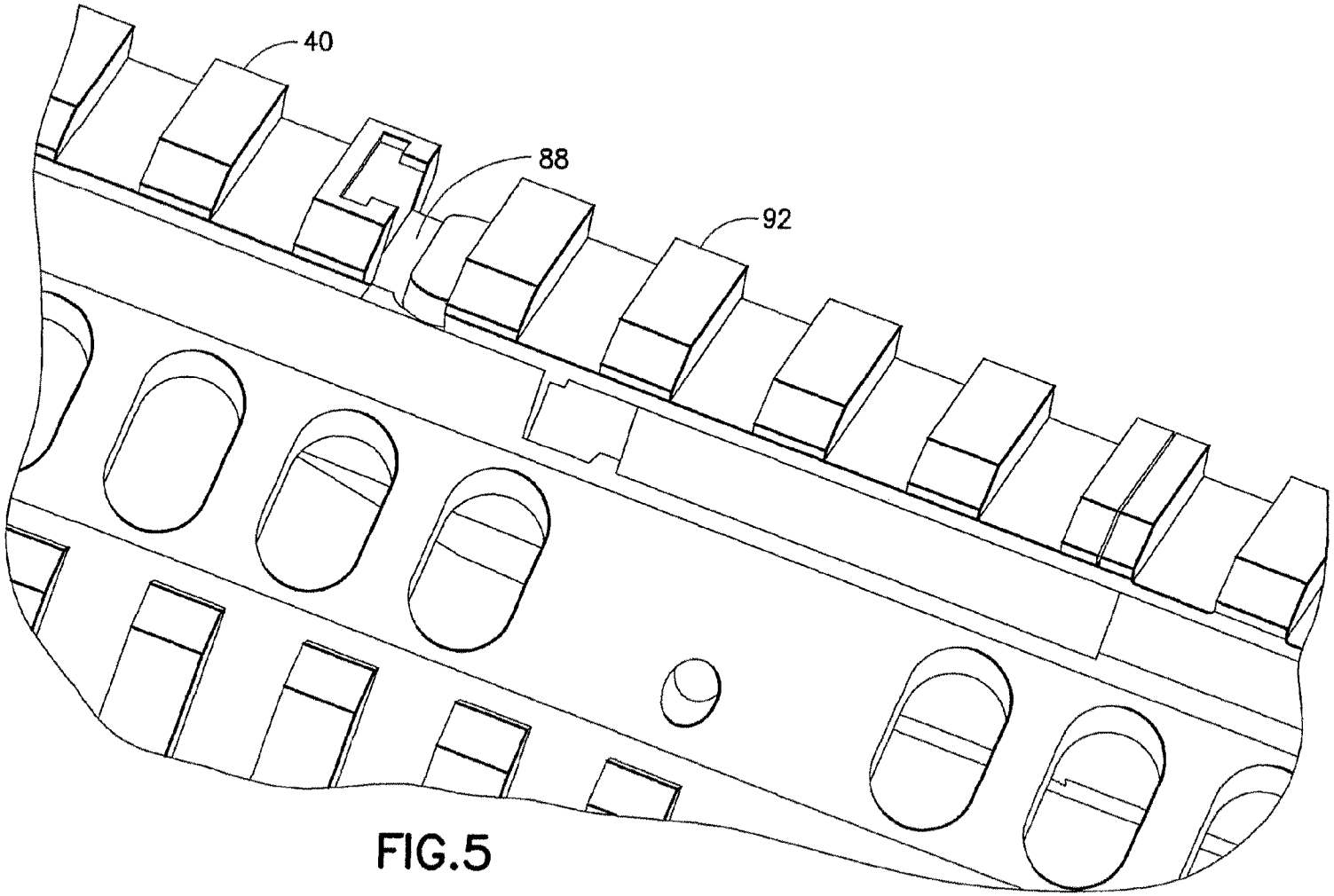
FIG. 5 is an isometric view of a piston housing in the upper receiver section of the firearm shown in FIG. 1.
Figure 6:
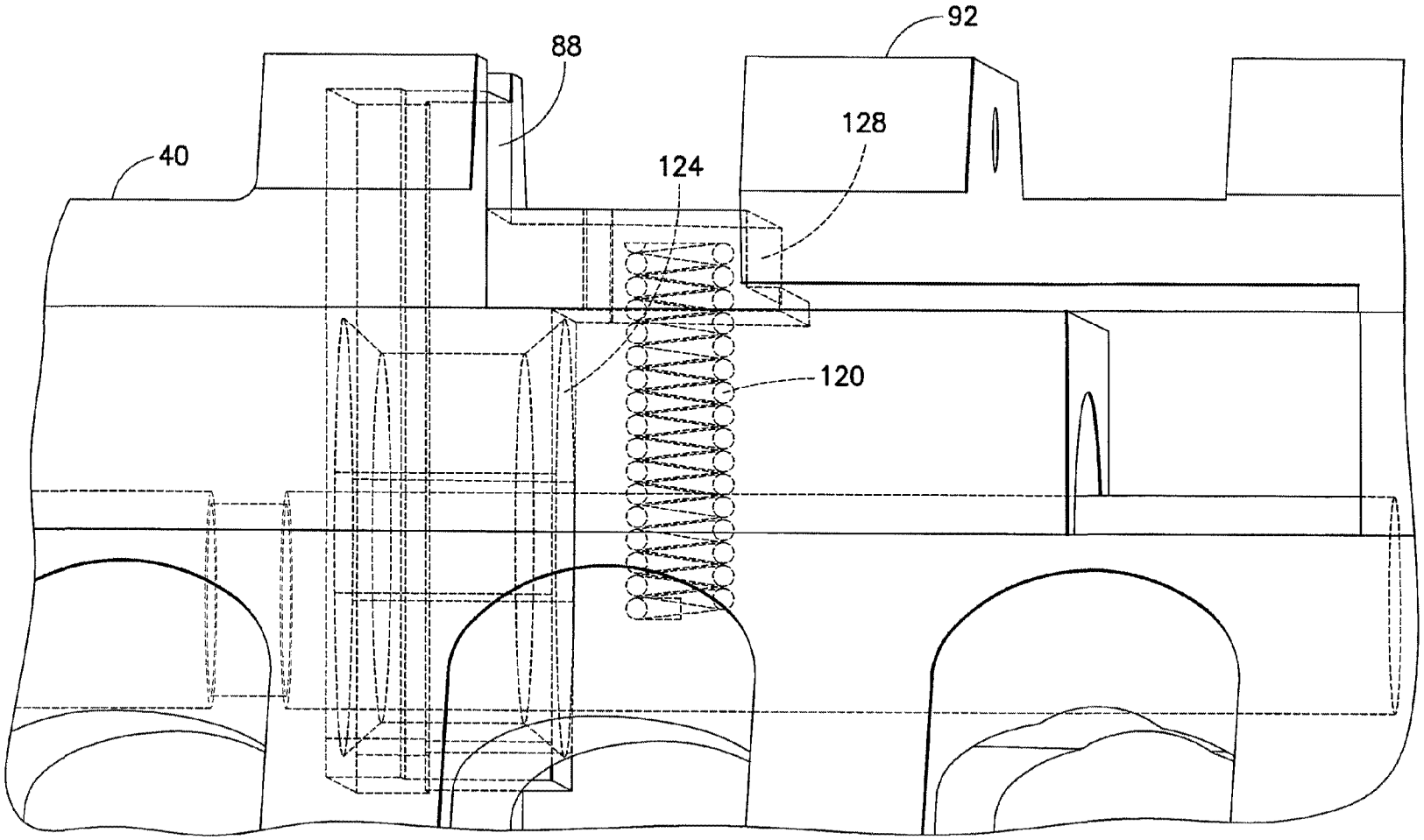
FIG. 6 is a partial section view of a piston housing in the upper receiver section of the firearm shown in FIG. 1.
Figure 7:
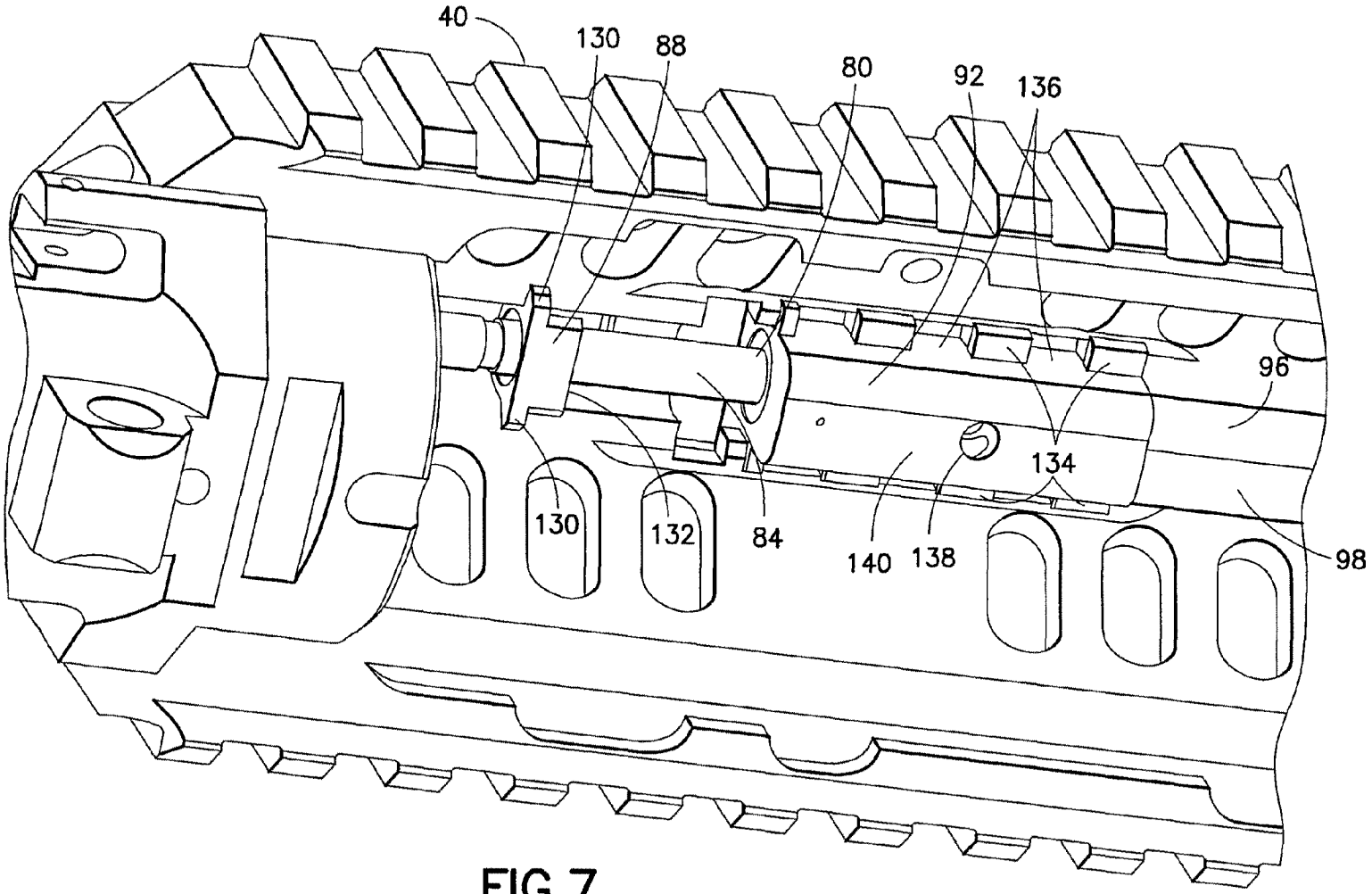
FIG. 7 is a partial section view of a piston housing in the upper receiver section of the firearm shown in FIG. 1.

Referring also to FIG. 5, there is shown an isometric view of a piston housing in the upper receiver section of the firearm shown in FIG. 1. As noted before, the upper receiver 34 in the exemplary embodiment is shown, for example purposes only, as a one-piece member of unitary construction having an integral hand guard section. In alternate embodiments, the receiver may be an assembly with a removable hand guard section that is mounted or otherwise substantially fixed to the receiver. In still other alternate embodiments the hand guard section may be mounted in any other desired way, such that when mounted the hand guard is not fixed to the receiver. In the exemplary embodiment stop plate 88 may be provided to retain or release cylinder housing 92 and may act as a stop to prevent piston over travel. In the exemplary embodiment shown, disassembly of the cylinder housing 92 from the hand guard portion 40 may be effected by pushing down on stop plate 88 and sliding the cylinder housing 92 to the rear of the firearm. Although cylinder housing is shown in the twelve o'clock position as an extension of hand guard's rail system, any suitable location may be provided. As can be seen in FIG. 6, spring 120 may be provided between hand guard portion 40 and stop plate 88 to load stop plate 88 in a raised position retaining cylinder housing 92. Here stop plate locks with tab 128 under housing 92 and prevents rearward movement. As can be seen in FIG. 7, tabs 130 may be provided on stop plate 88 that engage mating slots in hand guard 40 that retain the position of stop 88 while allowing vertical motion. In the exemplary embodiment, surface 132 is provided on stop 88 to stop piston 80 over travel. In alternate embodiments, no stop plate may be used, the piston stroke being stopped or snubbed by any suitable snubbing structure, such as a surface of the receiver, hand guard or cylinder housing.

Figure 8:
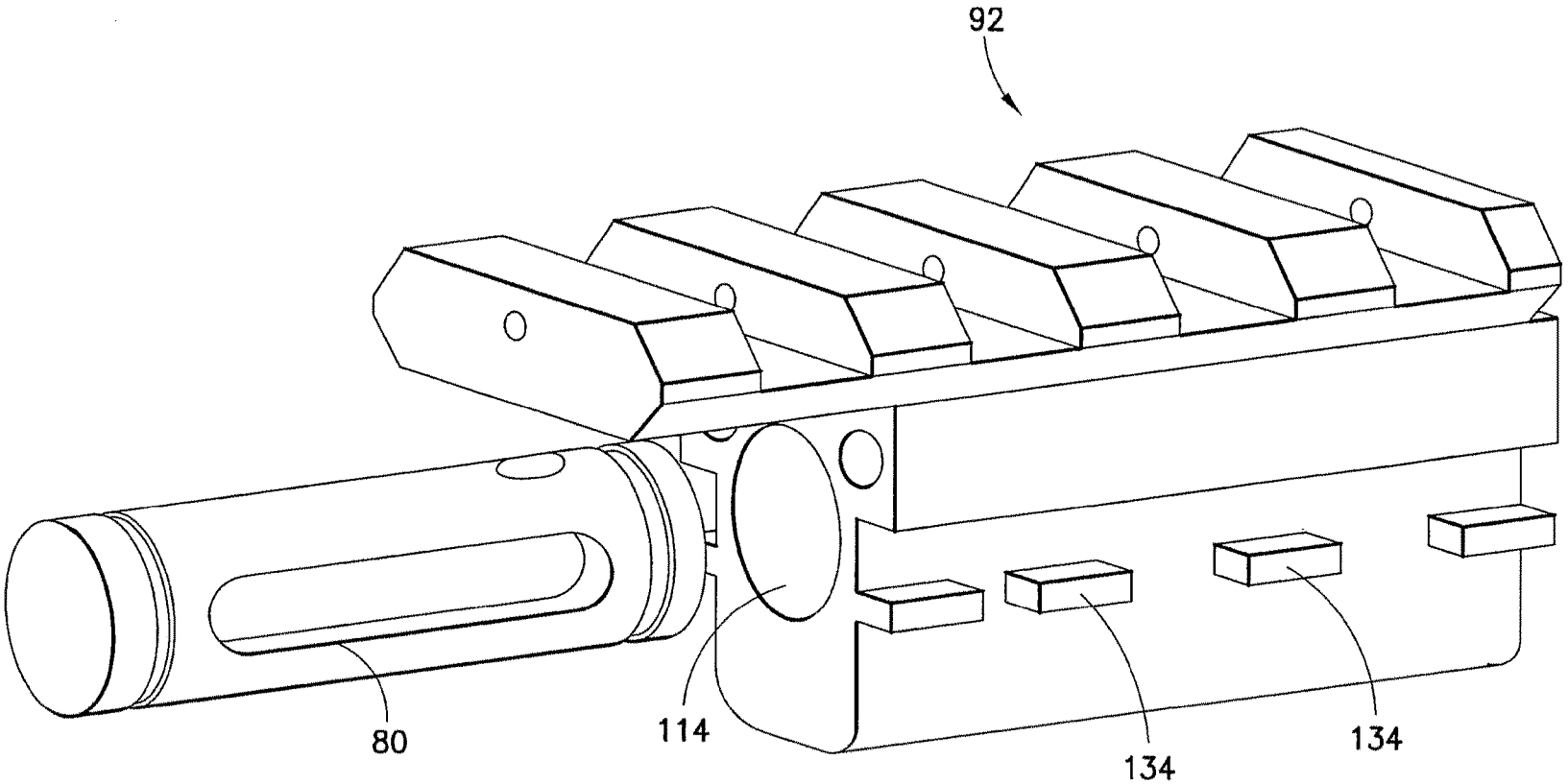
FIG. 8 is an isometric view of a piston and housing.
Figure 9:
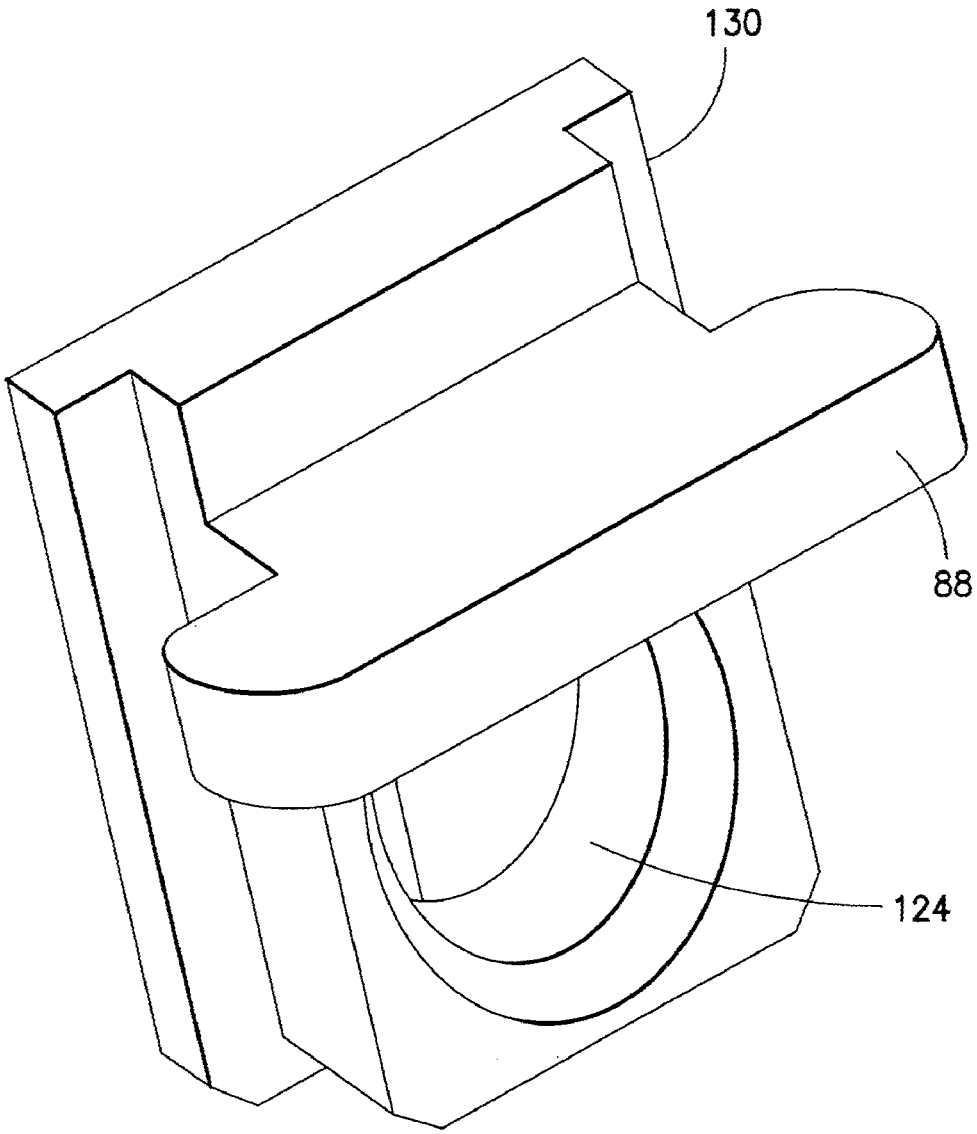
FIG. 9 is an isometric view of a stop plate.
Figure 10:
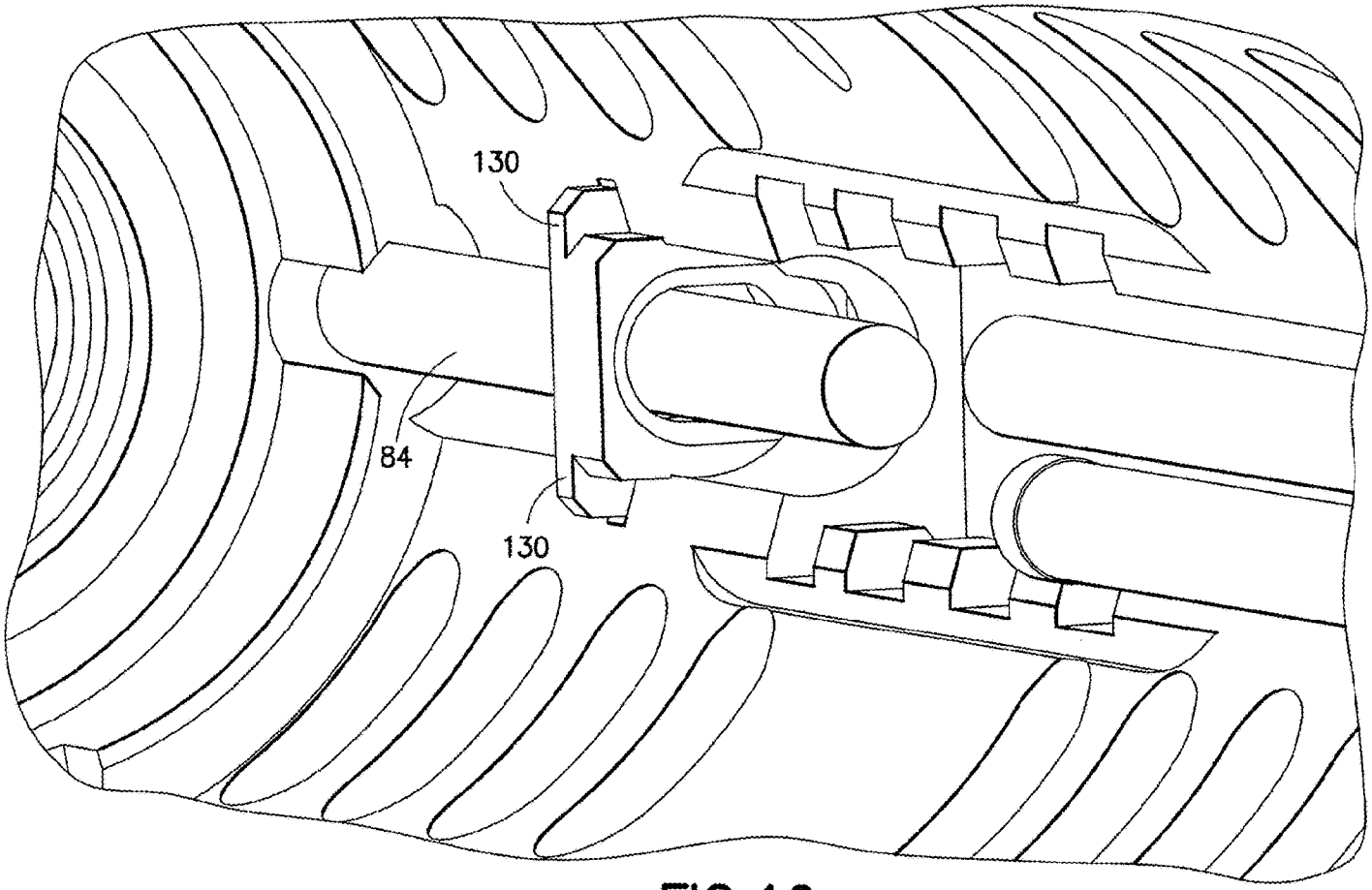
FIG. 10 is a partial section view of a piston in the upper receiver section with the piston housing removed of the firearm shown in FIG. 1.
Figure 11:
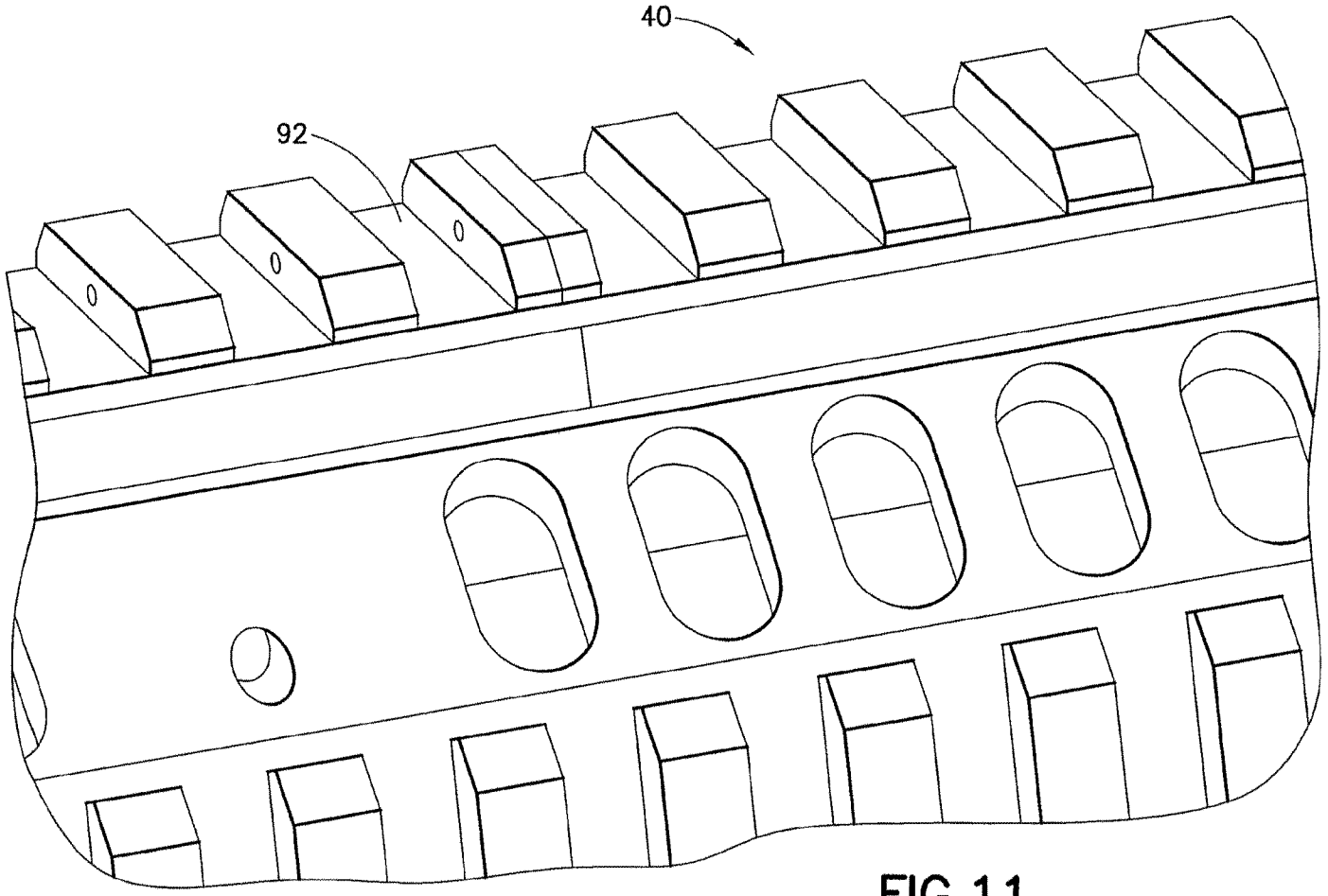
FIG. 11 is an isometric view of a piston housing in the upper receiver section of the firearm shown in FIG. 1.
Figure 12:
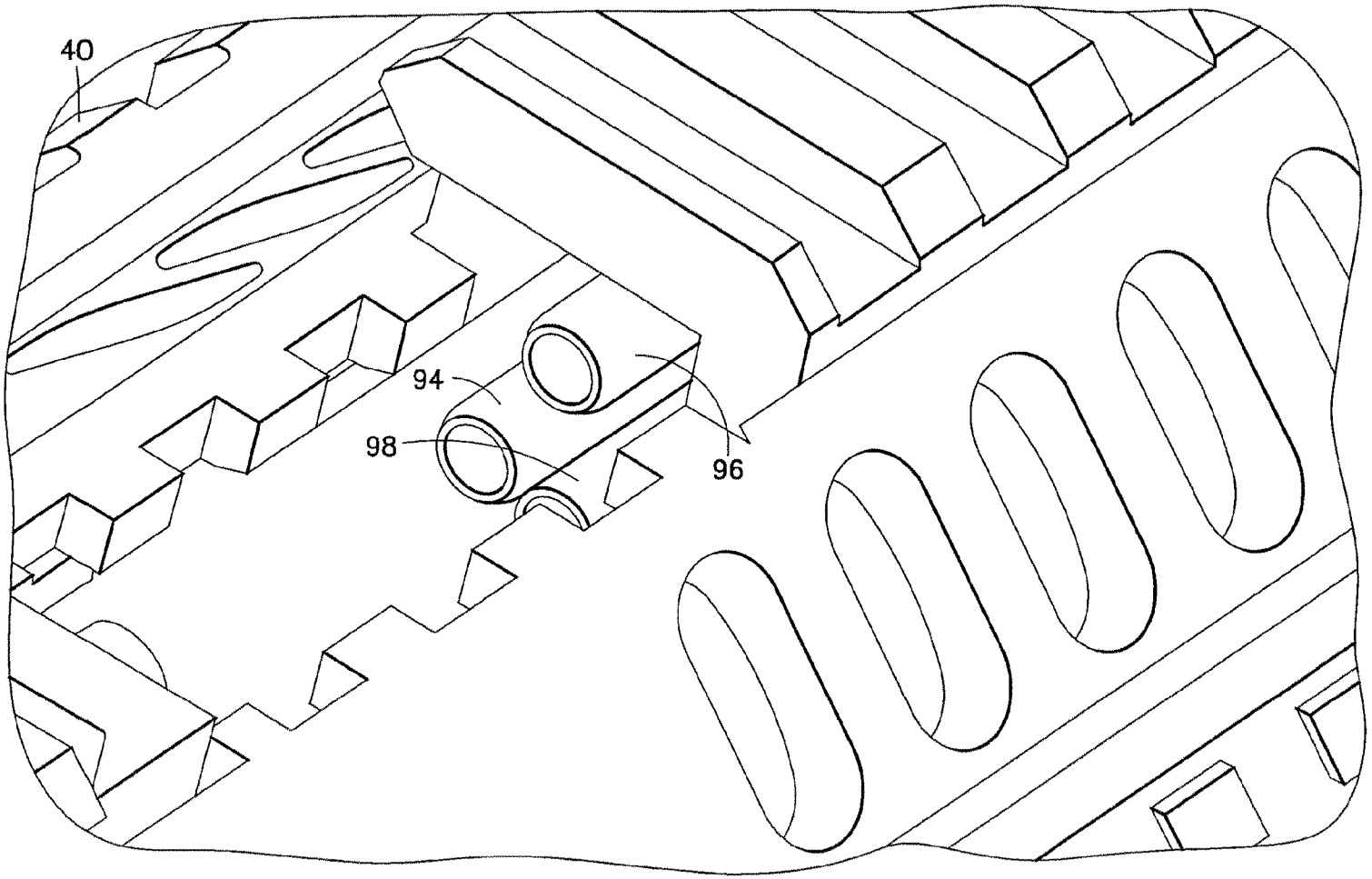
FIG. 12 is a partial section view of a upper receiver section with the piston housing removed of the firearm shown in FIG. 1.

As noted before, the cylinder housing is mounted to the rifle so that it is dependent from and fixed with the receiver 34 and decoupled structurally from the barrel. In the exemplary embodiment shown, housing protrusions or retention teeth 134 are provided on cylinder housing 92 that mate with an engaging surface on hand guard portion 40 to retain housing 92 when in the forward position as shown in FIG. 7. Slots 136 are provided in hand guard portion 40 that allow teeth 134 to pass through after sliding housing 92 rearward and removing housing 92 from guard portion 40. In the exemplary embodiment port 138 and bore are provided to exhaust gas from the cylinder when the piston passes. A plug (not shown) is also provided in port 138. As can be seen in FIG. 8, piston 80 can be removed from cylinder bore 114 of housing 92 once housing 92 is removed from the hand guard portion 40. As can be seen in FIGS. 9 and 10, slot 124 is also provided through stop plate 88 allowing operating rod 84 to pass there through. Here, stop plate 88 has an oval hole for disassembly and is held on the rail of guard portion 40 by the operating rod 80. Piston 80 and cylinder housing 92 may be removed to slide the operating rod to the rear to remove stop plate 88 from the rail of guard portion 40. As can be seen in FIG. 11, when housing 92 is assembled to hand guard portion 40, housing 92 engages the rail of guard portion 40 and becomes part of it. Assembly of housing 92 to guard 40 may be effected sliding housing forward under the lip to engage the tubes 96, 98 and lock stop plate 88 in the raised position. Referring also to FIG. 12, guard 40 is shown with housing 92 removed. A manifold (not shown) may be provided to support the tubes—input 96 and exhaust 94, 98. In alternate embodiments, no manifold may be provided.

Figure 13:
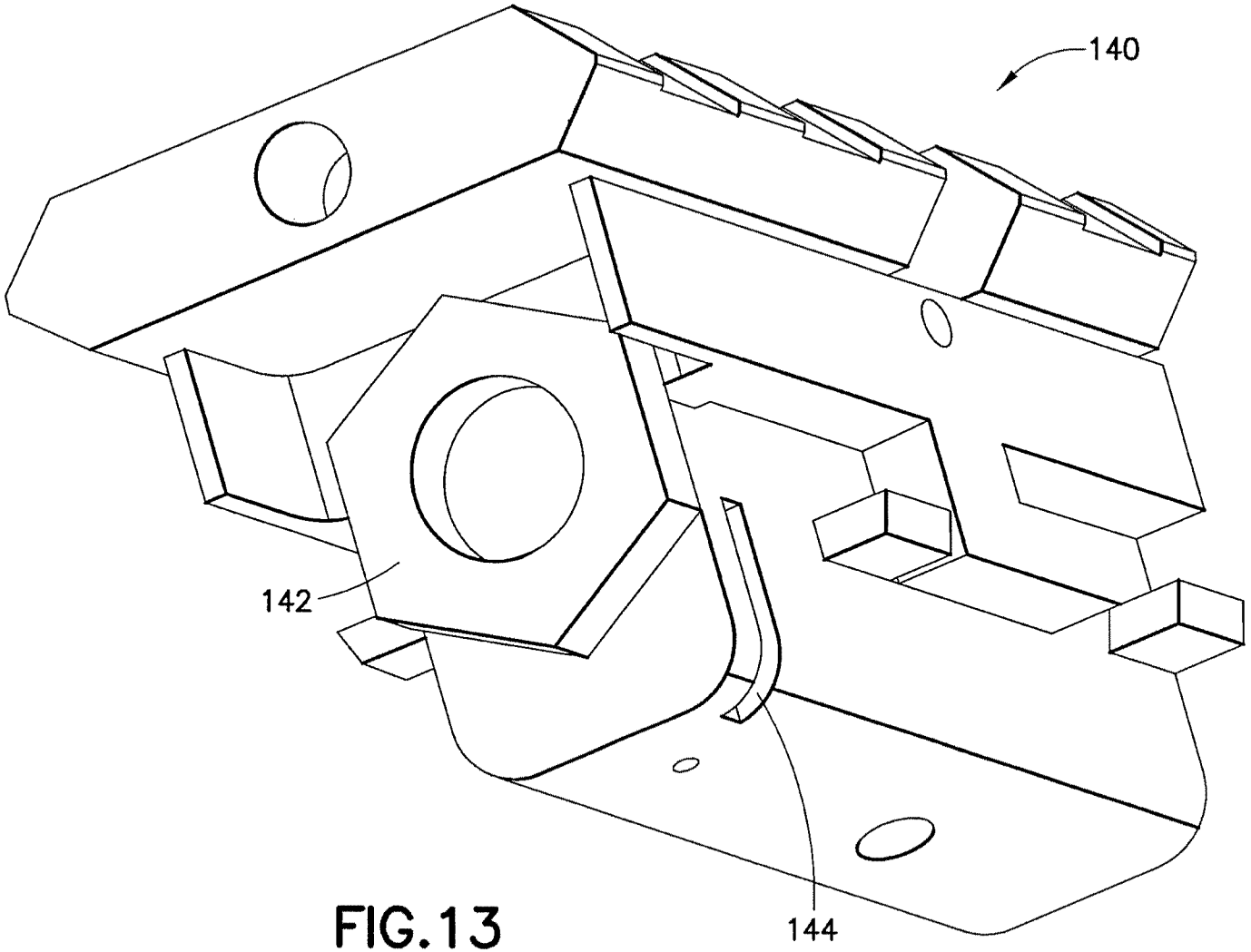
FIG. 13 is an isometric view of a cylinder assembly with a slide lock.

Referring now to FIG. 13, there is shown an isometric view of a cylinder housing 140 in accordance with another exemplary embodiment. Housing 140 is shown with cylinder assembly 142 and slide lock 144. Slide lock 144 may engage a mating slot in cylinder 142 to prevent cylinder 142 from removal from housing 140. A surface of slide lock 144 may define a snubbing surface delimiting the stroke of the piston if desired. Upon removal of slide lock 144 from housing 140, cylinder 142 may be removed from housing 140. When housing 140 is installed within guard portion 40, slide lock 144 is retained in housing 140 by a wall portion of the guard 40.

Figure 14:
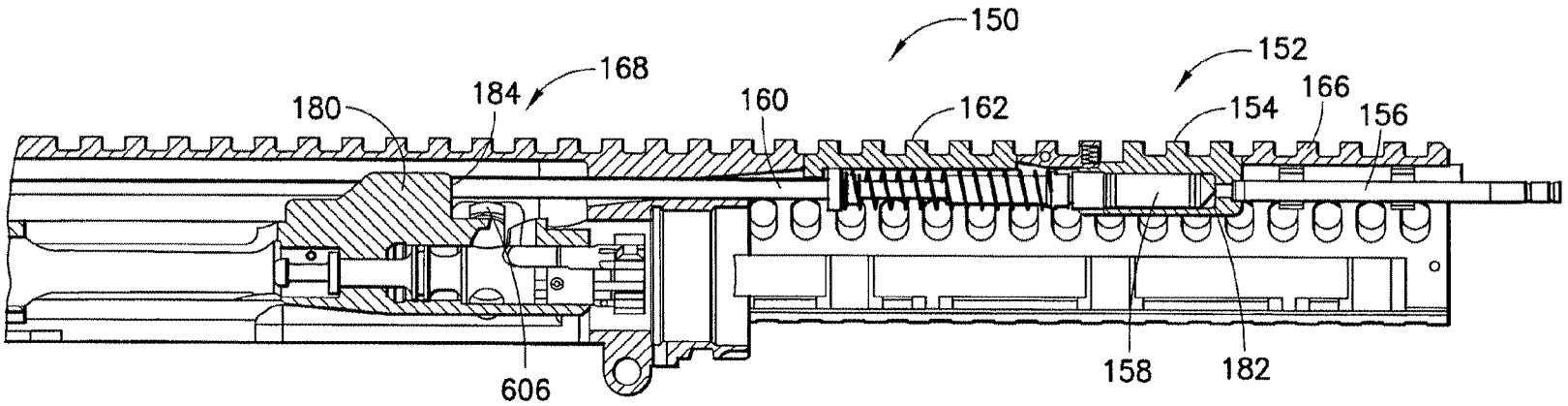
FIG. 14 is a section view of an upper receiver section.
Figure 15:
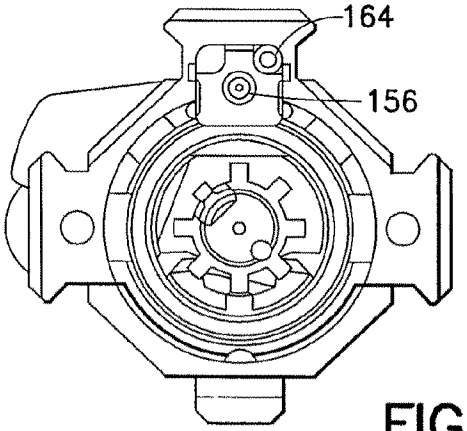
FIG. 15 is an end view of an upper receiver section.
Figure 16:
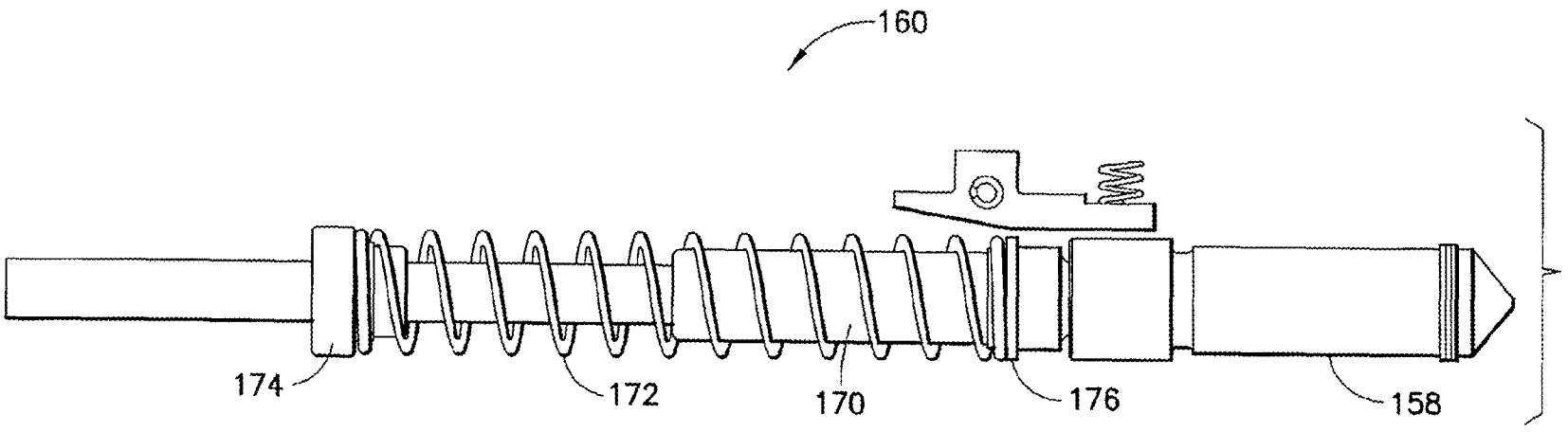
FIG. 16 is a side view of an operating rod and latch.

Referring now to FIG. 14, there is shown a section view of an upper receiver section of a firearm 150 and hybrid indirect gas operating system in accordance with another exemplary embodiment. Referring also to FIG. 15, there is shown an end view of the upper receiver section of FIG. 14. Firearm 150 may be similar to the firearm previously described. Here, firearm 150 as shown has a hybrid indirect gas operating system 152. In this embodiment, the cylinder block and piston assembly are dependent from and fixed with the receiver but spaced away from the chamber with the hand guard portion, for example, configured to house the cylinder block. In the exemplary embodiment shown, the operating system may have a spring loaded cylinder block, where the operating rod spring biases the piston to battery and biases the block forward against the stop and gas tube 156. The system 152 has a gas block (similar to the block shown in FIGS. 2, 22, 26) fitted to barrel assembly (not shown) where the gas block is in fluid communication with the barrel. The gas block (similar to gas block 72 in FIG. 2) may be mounted to the barrel or otherwise connected in any other suitable manner. Cylinder block or housing 154 is in fluid communication with gas block via gas tube 156. The cylinder block 154 may be made of steel or other suitable metal block. In alternate embodiments, non metal or plastic composite with liner and sleeve for the cylinder may be provided. Piston 158, striking operating rod assembly 160, stop plate 162, cylinder housing 182 and gas tubes 156, 164 (separate feed and exhaust tubes are shown for example purposes, in alternate embodiments only a single feed tube or common feed/exhaust tube may be provided) are housed within the hand guard portion 166 of upper receiver 168. Referring also to FIG. 16, piston 158 may have a bore that mates to (e.g. accepts the tip of) rod 170. Spring 172 and guide 174 are also provided. Guide 174 houses operating rod 170 allowing operating rod 170 to slide freely relative to the receiver. Guide 174 may also have a feature that mates with mating feature of receiver to correctly position rod 174 relative to the bolt carriage assembly within receiver. Spring 172 is provided between shoulder 176 of rod 170 and guide 174 to bias the rod toward the cylinder housing. The spring may not contribute to the dynamics of the operating rod and piston and the bolt reciprocation may be the primary contributor. The spring may maintain preload with the piston. As will be described below, cylinder housing 154 is mounted to hand guard portion 166 and removable for cleaning. In the exemplary embodiment the operating system 152 may be removed and installed substantially as a unit or module. The spring 172 may define a retention member holding the guide 174, operating rod 170, piston 158 and cylinder housing 182 together as an assembly for unit removal and installation. As may be realized, the indirect operating system may be removed from the firearm (whether as a unit or as individual components) independently without further disassembly of the firearm other than the removal of the indirect gas operating system. Conversely, the gas operating system may be installed in the firearm with the firearm substantially assembled but for installation of the indirect gas operating system.

In the exemplary embodiment, cylinder housing 154, and rest of operating system being mounted to the receiver, via for example hand guard portion 166, is fixed with the receiver and isolated from deflection or movement of the barrel. As such, cylinder housing 154 maintains parallel alignment with bolt carrier 180. Piston 158 is removable and fitted to the cylinder 182 within cylinder housing 154. The cylinder housing in the exemplary embodiment is shown for example having one or more exhaust orifices or ports formed in the front end to interface with exhaust gas line 164. In alternate embodiments a single or common feed exhaust port may be used or the housing may have any number of common or distinct feed and exhaust ports. Bolt carriage assembly 180 has striking surface 184 cooperating with rod 160. When a cartridge is fired, pressurized gas enters the gas block, passes to the cylinder within housing 154 via gas tube 156, displaces piston 158 and causes striking rod 160 to strike striking surface 1184 displacing bolt assembly 180.

Figure 17:
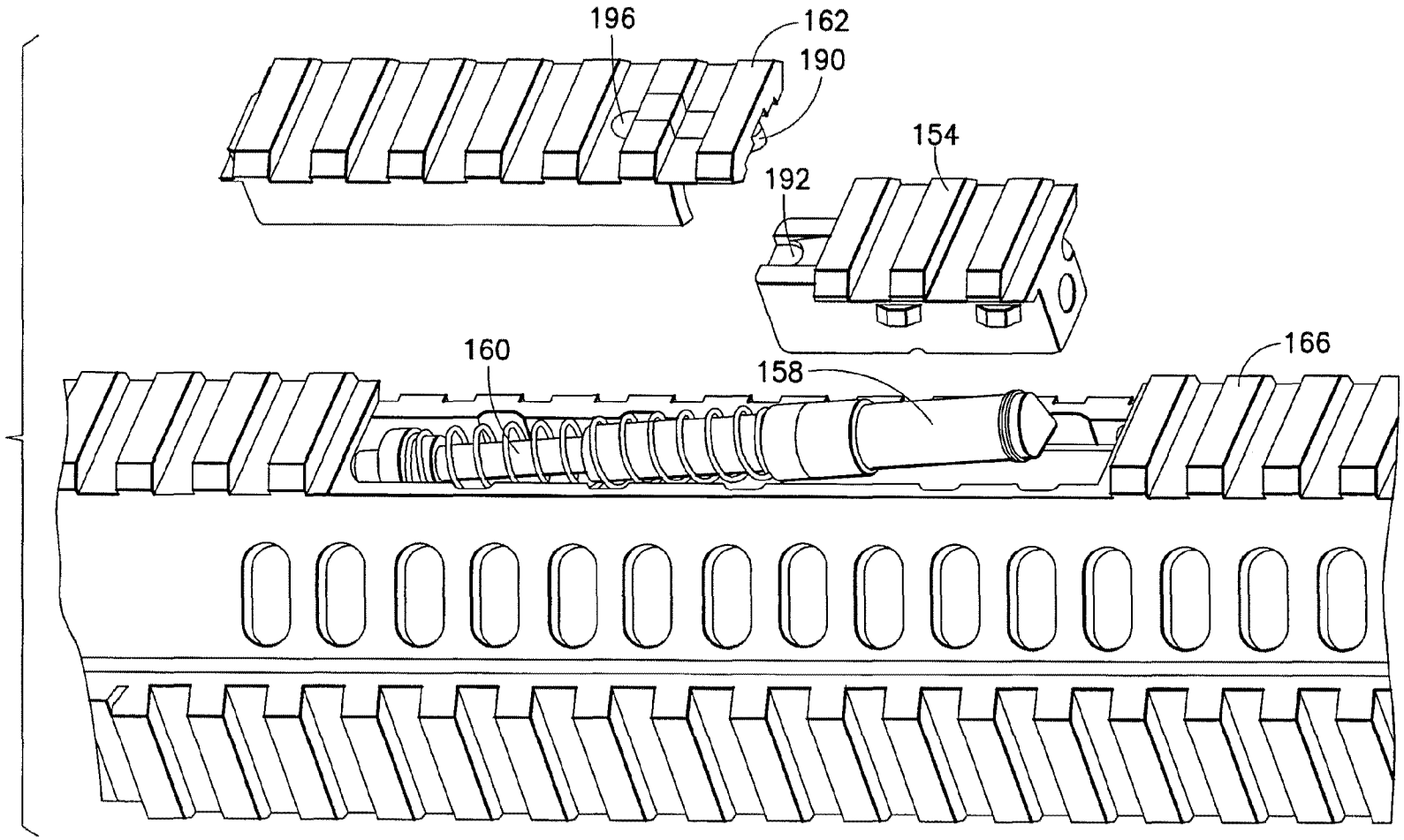
FIG. 17 is an exploded view of an upper receiver portion.
Figure 18:
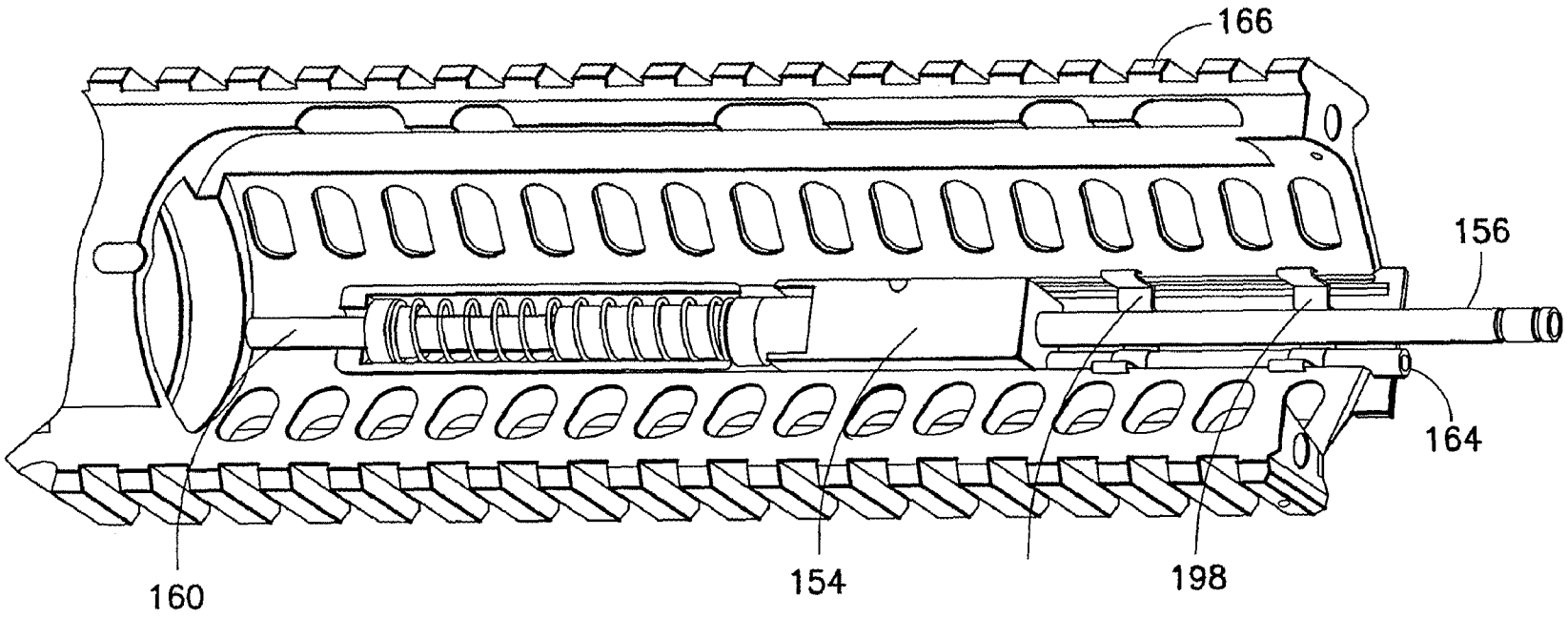
FIG. 18 is an isometric view of an upper receiver portion.

Referring now to FIGS. 17, 18 there is shown view of upper receiver portion 166 with stop 162, housing 154, rod 160 and piston 158 being removed. Referring also to FIG. 18, there is shown an isometric lower view of upper receiver portion 166 with stop 162, housing 154, rod 160 and piston 158 installed. In the embodiment shown, cylinder block 154 with piston 158 and operating rod extension 160 are assembled as a module and may be installed through the top of the hand guard with a movable top rail. In alternate embodiments, there may be a different insertion, for example, side insertion and removal. In the embodiment shown, stop 162 has a spring loaded release tab 190 that engages a mating feature 192 in housing 154. Upon depressing the forward portion 196 of tab 190, tab 190 disengages mating feature 192 of housing 154. Stop 162 may then be slid forward which disengages the teeth on stop 162 with the mating features on hand guard. Stop 162 may then be removed. Similarly, housing 154 may be slid back and removed. Clips 198 may be provided to retain tubes 156, 164.

Figure 19:
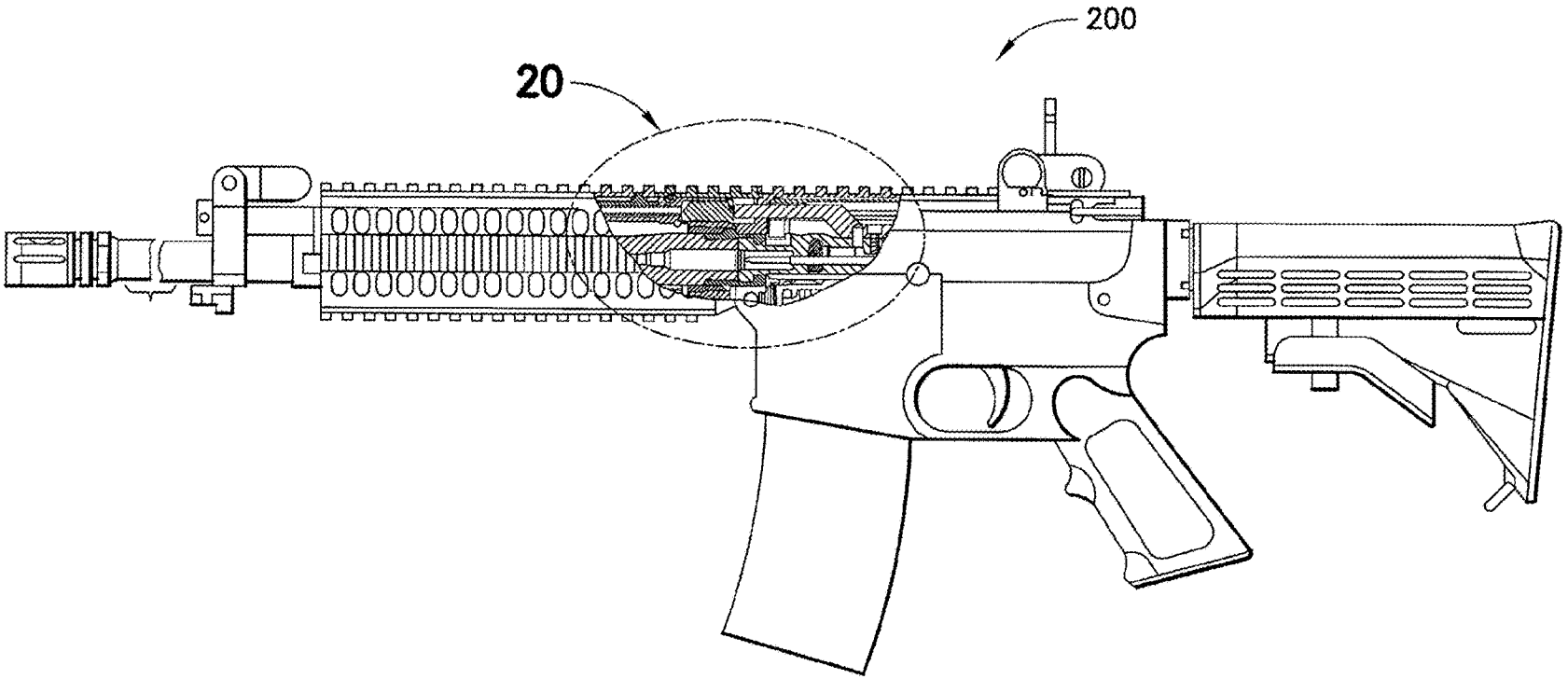
FIG. 19 is a side view, partially in section of a firearm.
Figure 20:
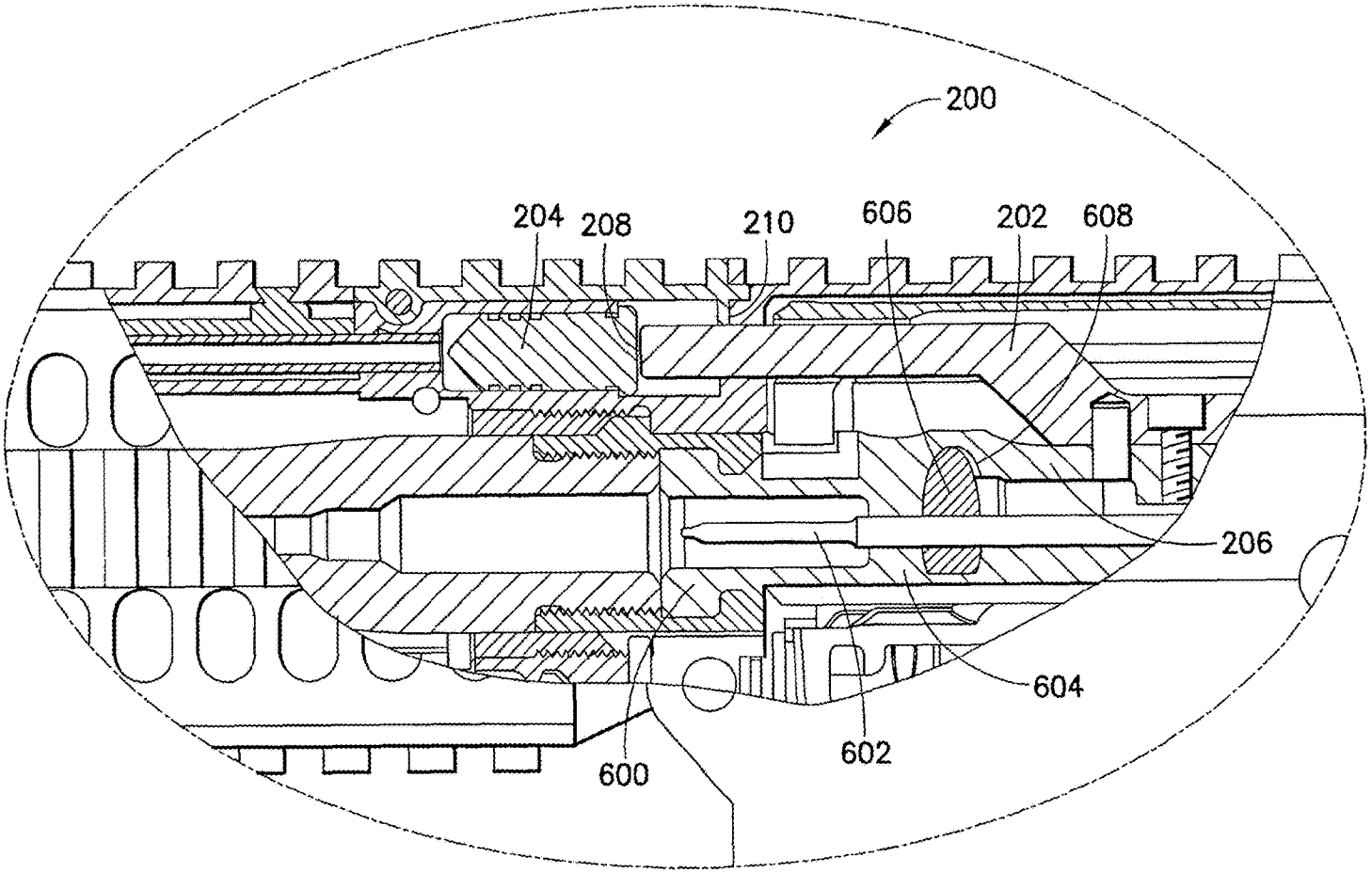
FIG. 20 is a side view, partially in section of a firearm.

Referring now to FIG. 19, there is shown a side view, partially in section of a firearm 200 in accordance with another exemplary embodiment. Firearm 200 may be generally similar to firearm 30 described previously except as otherwise noted. Referring also to FIG. 20 is shown a side view, partially in section of the firearm of FIG. 19. The embodiment shown may have similar features and operational characteristics as the previously described embodiments. In the embodiment shown, the operating rod may be integral with the bolt carrier key 202, or for description purposes it may be considered that the bolt carrier key may have an extension positioning the striking surface of the key so that the end of piston 204 strikes the striking surface as shown in FIG. 20, and disengages from the striking surface after striking Here, the bolt carrier key 202 moves with bolt the carrier 206 and having an elongated key. In alternate embodiments, the operating rod may be connected to and ride with piston 204 and striking on a stub key. Key 202 has a strike portion 208 and is struck by piston 204. Strike face 208 is located to be substantially coaxial with piston 204. Stop surface 210 may be provided in the upper receiver to prevent piston over travel. Bolt assembly 600 has bolt carrier 206 and firing pin 602 slidably mounted within bolt 604. The bolt is slidably mounted within the bolt carrier 206. Pin 606 is pressed into the bolt and interfaces with corresponding camming slot 608 of bolt carrier 206. Upon firing, camming slot 608 moves toward the rear of the firearm rotating the bolt until pin 606 bottoms out on slot 608. The resulting momentum of bolt carrier 206 displaces the bolt thus displacing the bolt assembly 600 to eject the cartridge and displace the hammer.

Figure 21:
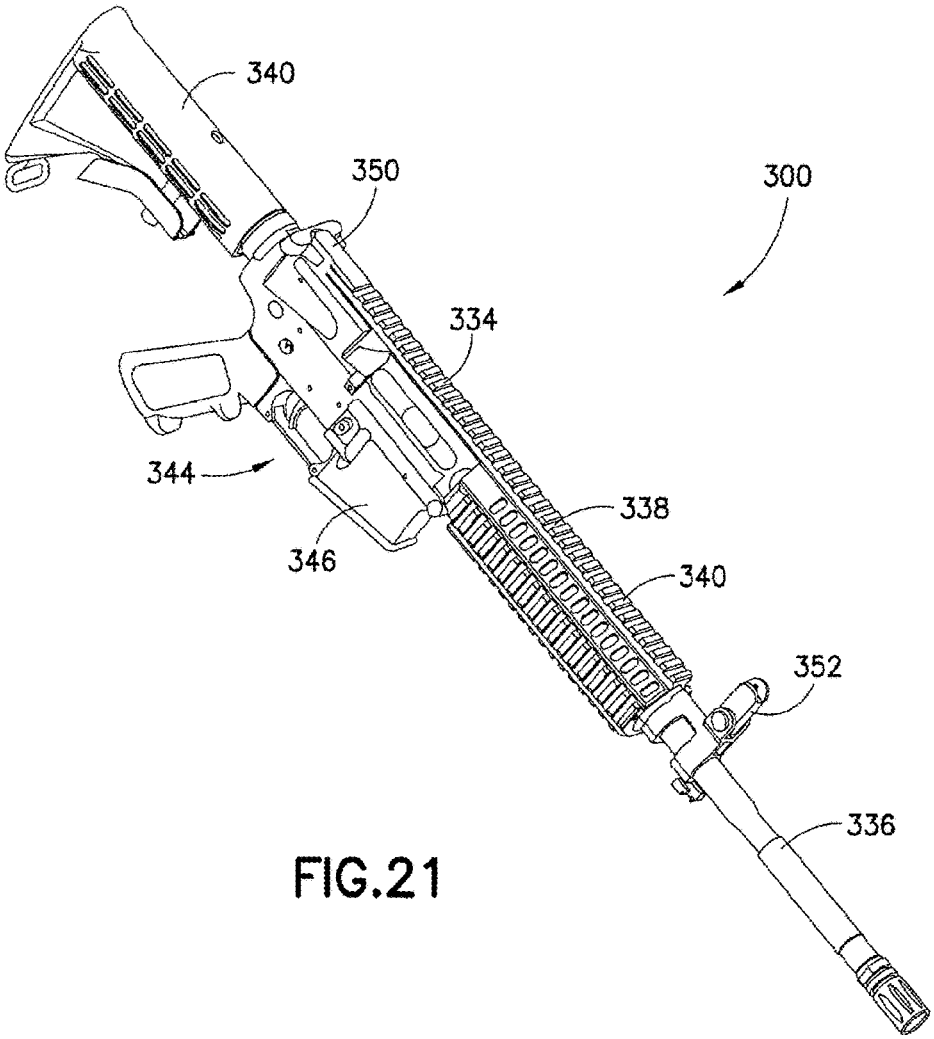
FIG. 21 is an isometric view of an automatic firearm incorporating features in accordance with an exemplary embodiment.
Figure 22:
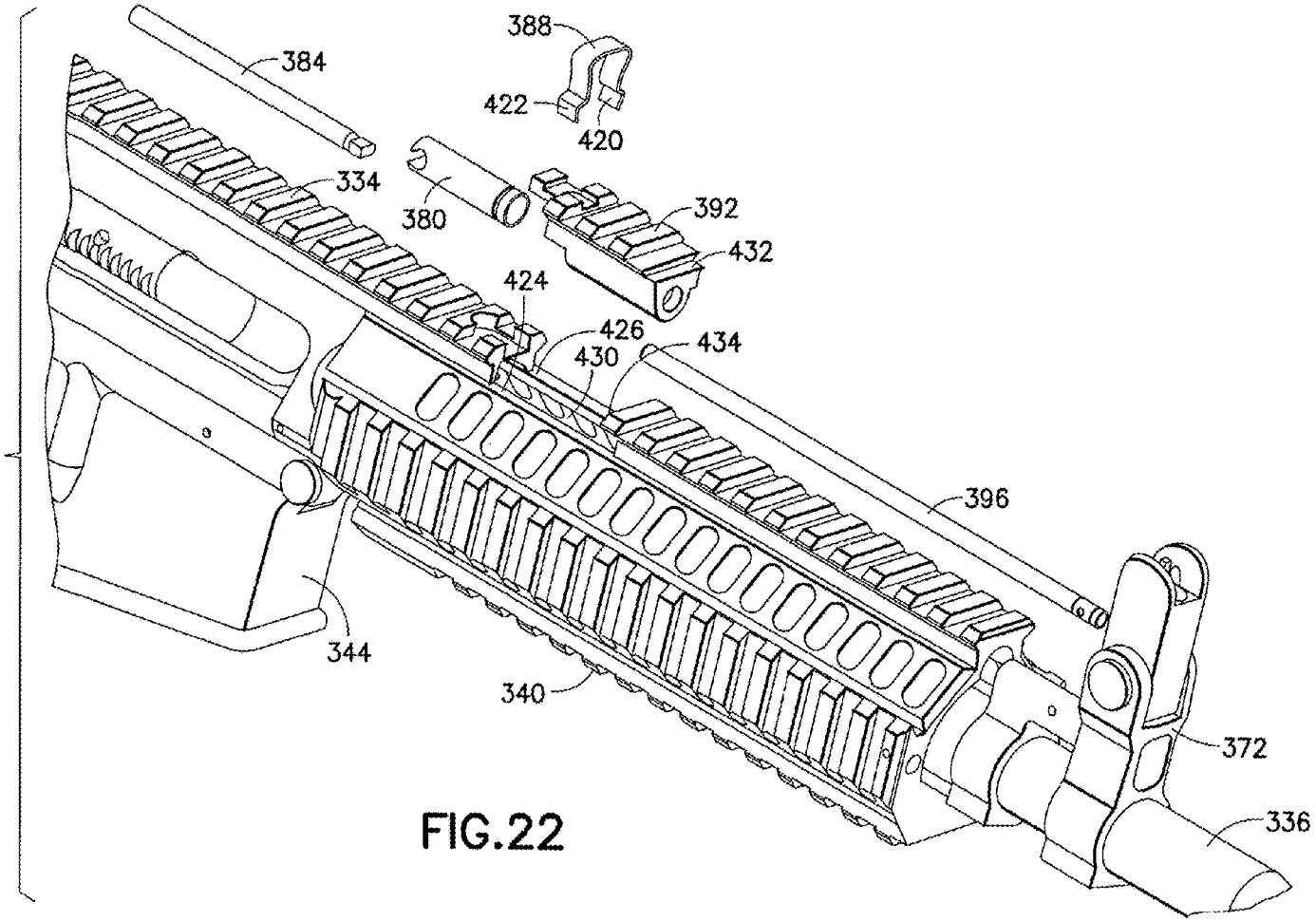
FIG. 22 is an exploded isometric view of the upper receiver section of the firearm shown in FIG. 21.
Figure 23:
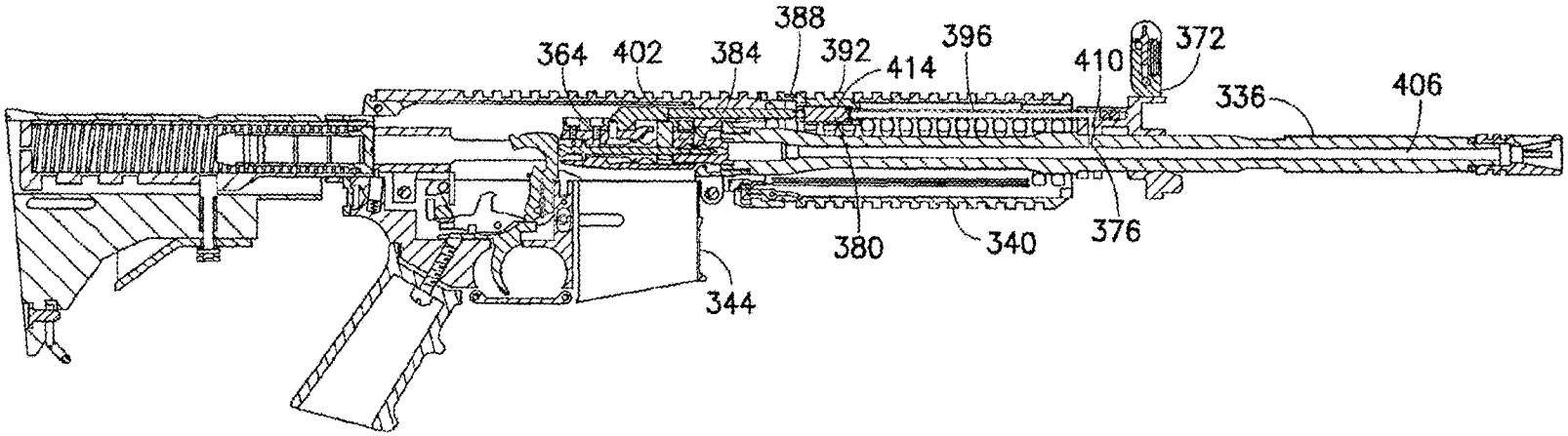
FIG. 23 is a section view of the firearm shown in FIG. 21.

Referring now to FIG. 21, there is shown an isometric view of an automatic firearm 300 incorporating features in accordance with another exemplary embodiment. Referring also to FIG. 22, there is shown an exploded isometric view of the upper receiver section of the firearm 300 shown in FIG. 21. Firearm 300 may have an upper receiver section 334 a barrel 336, hybrid indirect gas operating system 338, and hand guard portion 340 where hand guard portion 340 may be integral with or separable from upper receiver section 334. Rear sight assembly 350 is provided and mounted to upper receiver section 334. Firearm 300 may incorporate stock 342, lower receiver section 344, magazine well 346, clip or magazine (not shown) and rear and front sights 350, 352. Referring also to FIG. 23, there is shown a section view of the firearm 300 shown in FIG. 21. Firearm 300 has a hybrid indirect gas operating system 338 facilitating automatic or semi-automatic operation as will be described below. The indirect gas operating system may include a gas feed regulator capable of regulating gas flow for controlled feed gas flow to the remote operating system at a predetermined rate independent from variances in the barrel exhaust port. The regulator may be fixed, or adjustable, allowing the operator to vary cyclic rate as desired. The operating system 338 is structurally decoupled from the barrel where the structural mounting and location of system 338 may be in the hand guard, receiver, or otherwise but not the barrel. Although the embodiment shown has a one piece receiver with integral hand guard, in alternate embodiments the hand guard may be removable from receiver where hand guard is decoupled from barrel. The system 338 interfaces to a gas block 372 fitted to barrel assembly 336 where barrel 336 has bore 406 with the gas block being in fluid communication with the bore through a port 376 in barrel 336 (see FIG. 23). The gas block is in fluid communication with the bore through a corresponding port 410 disposed on a surface of the gas block facing the barrel. Cylinder housing 392 is remote from the gas block 372, and is in fluid communication with gas block 372 via gas tube 396. In the exemplary embodiment shown a common gas tube 396 serves to feed gases to and exhaust gases from cylinder housing 392. Piston 380, striking or operating rod 384, retaining clip 388, cylinder housing 392 and gas tube 396 are housed within the hand guard portion 340 of upper receiver 334:

Cylinder housing 392 is mounted to hand guard portion 340 of receiver 334 and removable from hand guard portion 340 for cleaning Removal of cylinder housing 392 may be effected by removal of retaining member, illustrated for example as a clip 388, from hand guard portion 340. Clip 388 may be spring loaded having for example resiliently compliant legs 420, 422 that are formed to be retained by and mate with detents or back cuts 424, 426 in opening 430 of hand guard portion 340 where opening 430 accepts housing 392. After clip 288 is removed, housing 392 may be slid toward the rear of firearm 330 and removed. The connection between piston 380 and operating rod 384 may be removed to remove housing 392. In alternate embodiments the retaining member may have any other suitable configuration. In the embodiment shown, a piston stop washer is not provided; instead, the receiver structure is used for piston stop. Piston 380, and rod 384 may then be subsequently removed. Housing 392 has mating surface 432 that mates with lip 434 under the upper rail of hand guard 340 when assembled. Cylinder housing 392 being mounted to hand guard portion 340 of receiver 334 is isolated from deflection or movement of barrel 336 during firing. As such, cylinder housing 392 maintains parallel alignment with bolt carrier 364. Here, the cylinder housing, piston and operating rod module is independent of and decoupled from the barrel and mounted to the upper receiver shifted forward and away from the chamber. This avoids delivering heat into the loaded chamber. Decoupling from the barrel eliminates issues associated with a barrel mounted piston assembly such as heat deflection and barrel whip. Additionally, there is less concern of binding due to decoupling of the operating system from the barrel. Piston 380 is fitted to the cylinder 414 within cylinder housing 392. The piston 380 is movably fitted to the cylinder housing 392. The striking rod 384 may be joined at its front end, for example by a compliant connection, to the piston 380. In alternate embodiments, other suitable connections may be provided such as fixedly joined at its front end, for example by a threaded connection. Bolt carriage assembly 364 is provided within receiver 334. The bolt carriage assembly 364 has striking surface 402 cooperating with rod 384 of operating system 338. When a cartridge is fired, pressurized gas enters gas block 372, passes to the cylinder within cylinder housing 392 via gas tube 396, displaces piston 380 and causes striking rod 384 to strike striking surface 402 displacing bolt assembly 364. The gas feed regulator may be incorporated into the gas block or the cylinder housing or otherwise.

Figure 24:
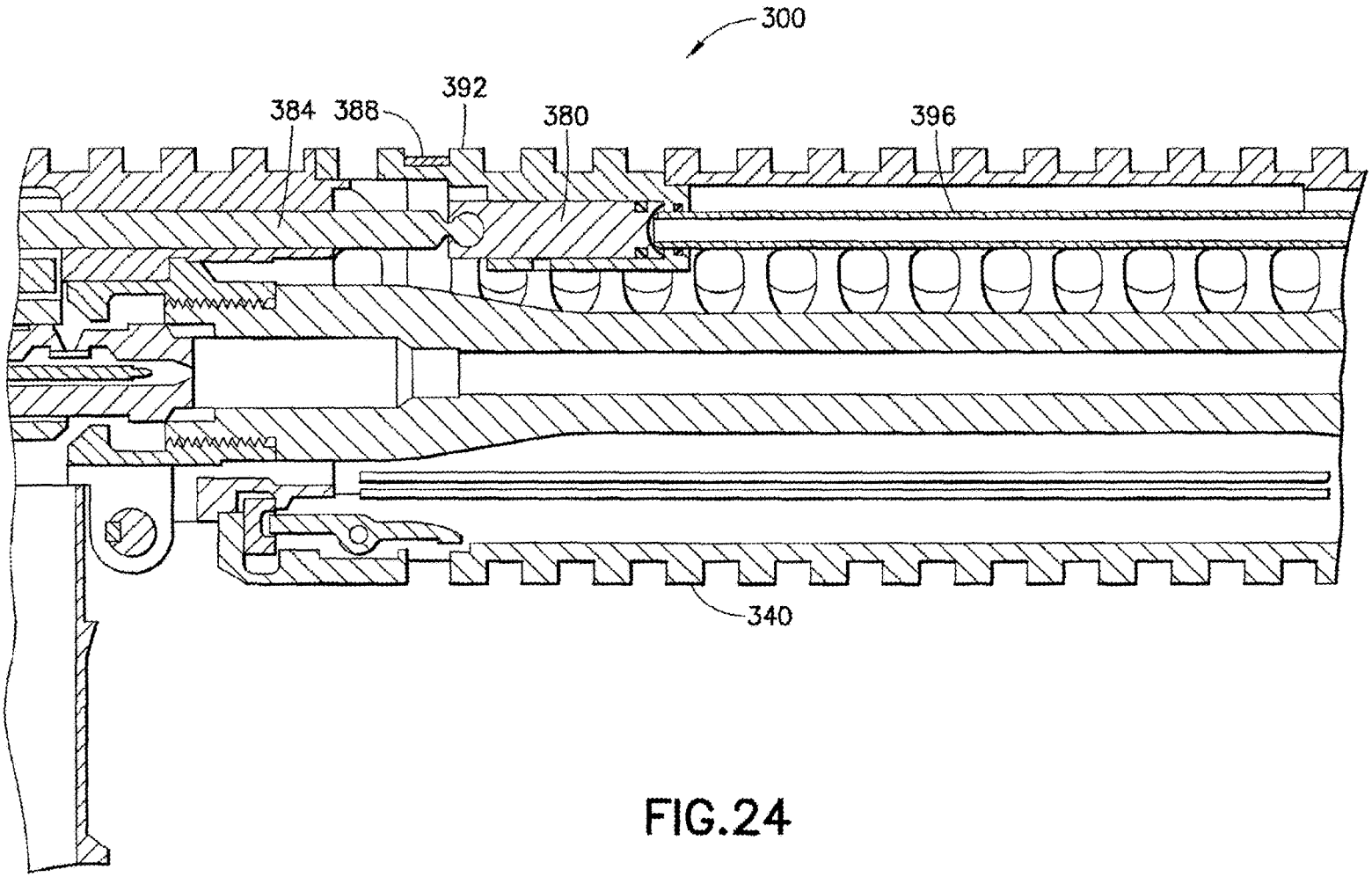
FIG. 24 is a section view of the firearm shown in FIG. 21.
Figure 25:
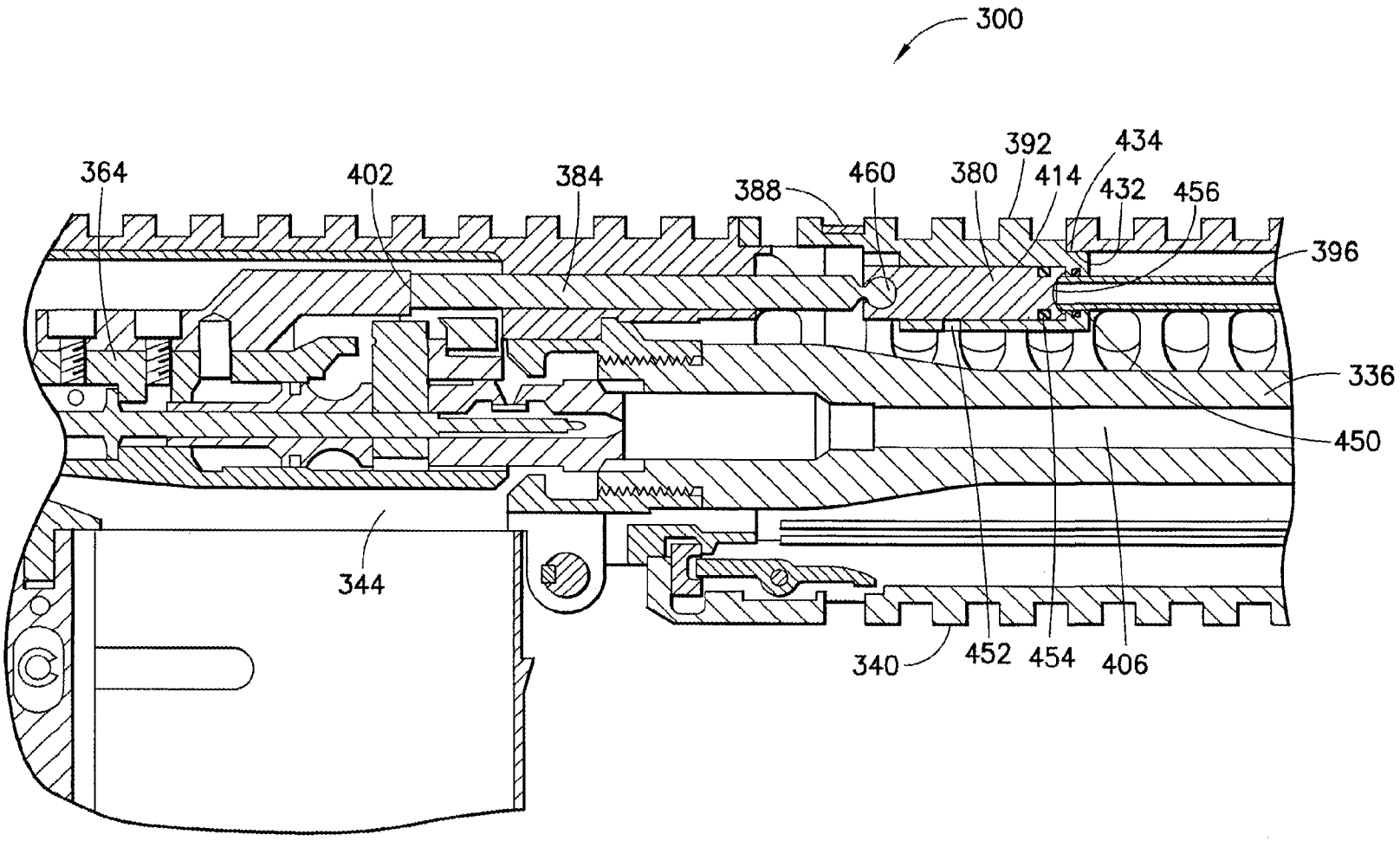
FIG. 25 is a section view of the firearm shown in FIG. 21.

Referring also to FIG. 24 there is shown a section view of the firearm shown in FIG. 21. Referring also to FIG. 25, there is shown a section view of the firearm shown in FIG. 21. Cylinder housing 392 is in fluid communication with barrel bore 46 via gas block 372 and via gas tube 396. Gas tube 396 has a tapered front portion that engages a bore 450 in housing 392. Bore 450 may have a chamfer that allows the tapered front portion to more easily be accepted upon assembly and may also have one or more, ring(s) with a corresponding back cut where the ring seals against tube 396. Here, bore 450 may have a clearance fit with tube 396 eliminating structural connection between barrel 336 and housing 392. Piston 380, striking operating rod 384, retaining clip 388, cylinder housing 392 and gas tube 396 are housed within the hand guard portion 340 of upper receiver 334. In the embodiment shown, there is not a separate exhaust line from cylinder 414. Instead, exhaust gases are routed back through feed line 396. Relief or bleed hole 452 is shown added to the periphery of cylinder 414 and is provided to blow-by but not necessarily the entire exhaust. In alternate embodiments, the bleed hole may be provided anywhere and with any suitable shape, for example, the relief hole may be channeled or slotted to vent forwards. Bleed hole 452 aids residual pressure release to reduce blow by. In alternate embodiments there may be no bleed/hole 452. Piston 380 is shown for example having seal rings 454 and domed-in hollow face 456 with the piston face rim of face 456 seating against the front wall of cylinder 414 when at battery position. The hollow may be provided sufficiently deep to provide desired clearance with gas tube exhaust line 396. Here, the tube end may penetrate through cylinder front wall into the cylinder 414 interior. The hollow also provides a desired cylinder volume Vo at battery where Vo may be varied, for example, with barrel length for desired operating system dynamics. By way of example, in the exemplary embodiment, different interchangeable cylinder housings (similar to housing 392) may be provided each configured to have a different desired volume Vo at battery, the user selecting the desired housing having the desired volume Vo to provided desired operating dynamic to the firearm, and installs the selected housing in the firearm. Piston 380 is movably fitted to the cylinder 414 within cylinder housing 392. The striking rod 384 may be joined at its front end, for example by a compliant connection, to the piston 380. In alternate embodiments, other suitable connections may be provided such as fixedly joined at its front end, for example by a threaded connection. In the exemplary embodiment, the coupling between operating rod 384 and piston is shown as capable of allowing compliance articulation of the operating rod having a piston end and a striking end. Here, articulating joint 460 may allow for angular motion between the piston end and the striking end and may reduce the potential for misalignment and prevent binding of the operating system and allows for in place decoupling of piston and operating rod. In the embodiment shown, the articulating joint comprises a joint that has a ball (or any other desired) shaped surface on the piston end portion of the operating rod fitting into a conformal shaped depression slotted in the piston 380. The depression may have a slightly larger diameter than the ball shaped surface allowing the joint to be capable of motion around an indefinite number of axis. Removal of piston 380 from rod 384 requires relative axial movement such that the ball disengages the slot. A relief is cut in end portion of rod 384 allowing the joint 460 to rotate without binding. Here the connection between the piston and the operating rod allows the piston to be released from the operating rod in place. As previously described and in the embodiment shown, spring loaded removable retention clip 388 may be provided to retain housing 392. In alternate embodiments, any other suitable removable lock, for example, similar to a snap ring type lock may be provided. Housing 392 provides a one piece cylinder housing with integral rail where housing 392 is of unitary construction or alternately may be an assembly that is removable and installable in one step. In alternate embodiments, housing 392 may have a separate rail housing installable separately. Referring also to FIG. 22, an initial removal aperture 430 is formed into hand guard 340 for housing 392 removal. In this exemplary embodiment, removal is shown vertical; in alternate embodiments, removal may be otherwise, for example can be horizontal. Guide and stop surfaces 432, 434 are provided to position and hold housing 392. In alternate embodiments, housing 392 may be positioned anywhere. For example, engagement and disengagement between cylinder housing 392 and gas tube 396 may be forward or rearward—can be by moving cylinder housing 392, or moving gas tube 396 or both. In the exemplary embodiment, as may be realized, the indirect operating system may be removed from the firearm (whether as a unit or as individual components) independently without further disassembly of the firearm other than the removal of the indirect gas operating system. Conversely, the gas operating system may be installed in the firearm with the firearm substantially assembled but for installation of the indirect gas operating system.

Figure 26:
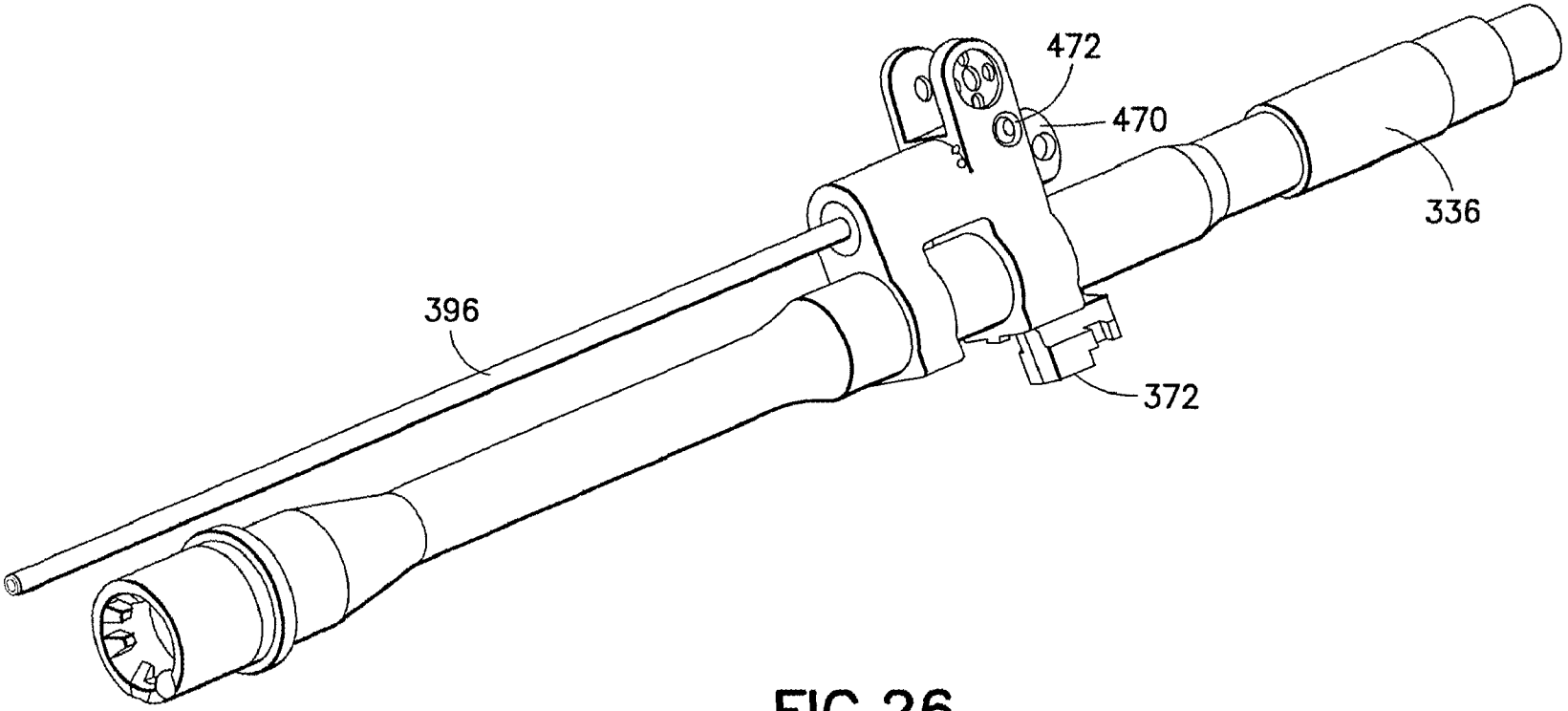
FIG. 26 is an isometric view of a barrel and gas tube assembly in accordance with features of an exemplary embodiment.
Figure 27:
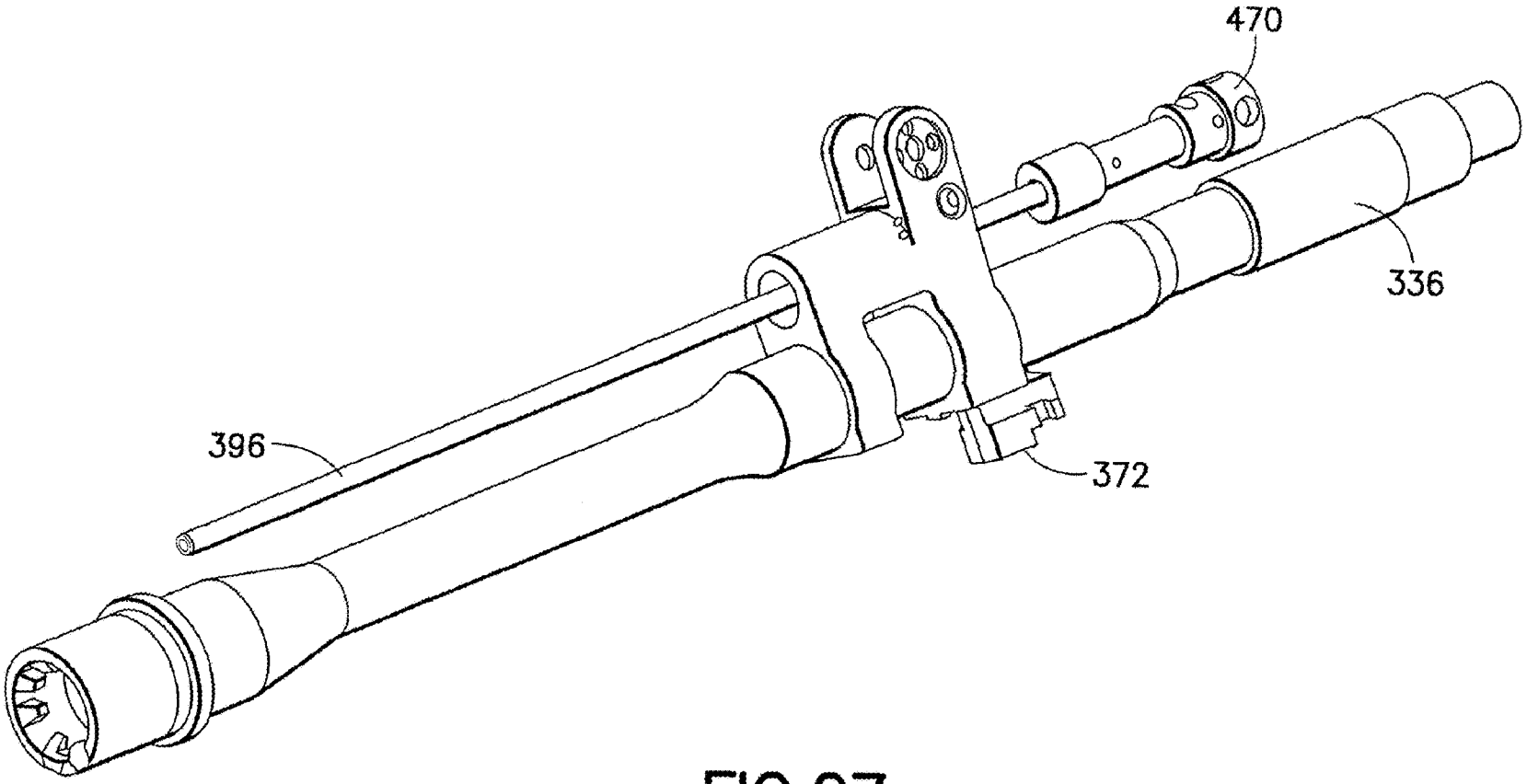
FIG. 27 is an exploded isometric view of a barrel and gas tube assembly.
Figure 28:
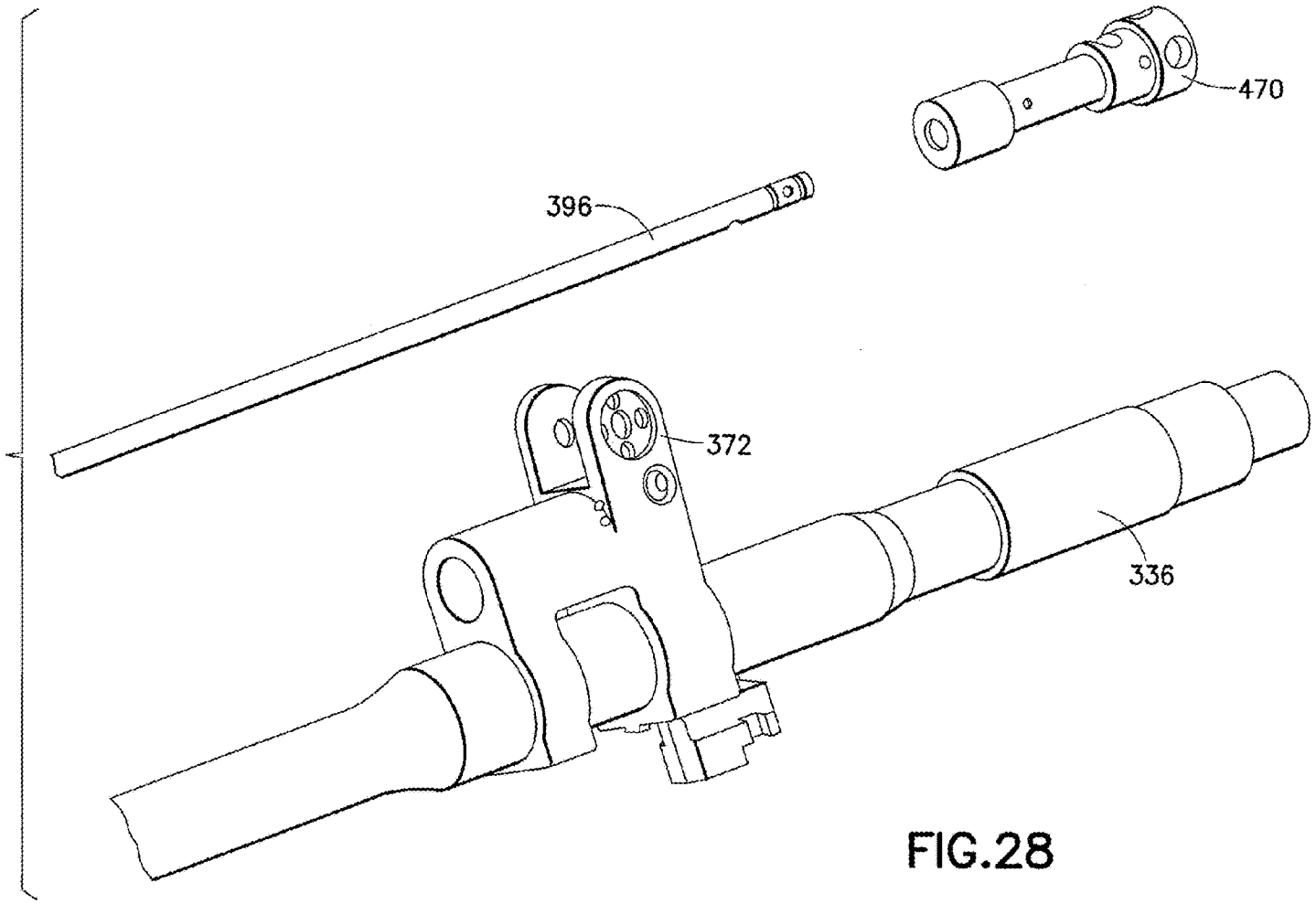
FIG. 28 is an exploded isometric view of a barrel and gas tube assembly.

Referring now to FIG. 26, there is shown an isometric view of a barrel and gas tube assembly of a firearm similar to firearm 30, 200. Referring also to FIG. 27, there is shown an exploded isometric view of a barrel and gas tube assembly. Referring also to FIG. 28, there is shown an exploded isometric view of a barrel and gas tube assembly. The system 338 interfaces with gas block 372 fitted to barrel assembly 336 where cylinder housing 392 (see FIG. 25) is in fluid communication with gas block 372 via gas tube 396 and removable sleeve 470. The sleeve 470 may be removable from the front of gas block 372 and therefore removable from the front of the receiver or rail. The sleeve may be suitably configured to allow for quick removal and installation to the firearm. As can be seen in FIGS. 27 and 28, this further enables removal of the gas tube 396 from the firearm as a unit without further disassembly. In the exemplary embodiment, removable sleeve 470 is maintained captive with takedown pin 472. A wave spring (not shown) may be provided under the head of sleeve 472 to bias sleeve 472 forward. The take down pin may be held captive.

Figure 29:
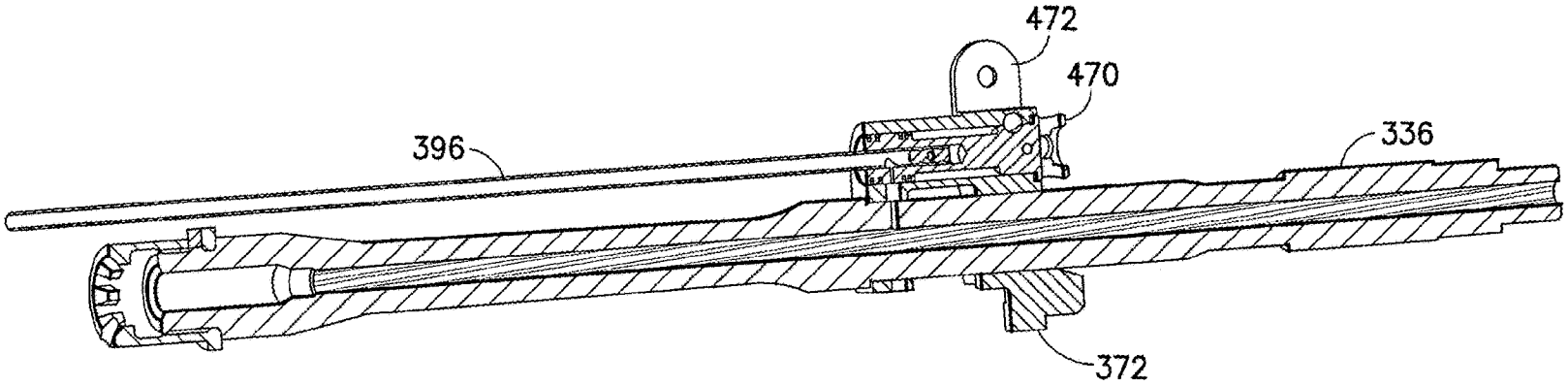
FIG. 29 is a section view of a barrel and gas tube assembly.
Figure 30:
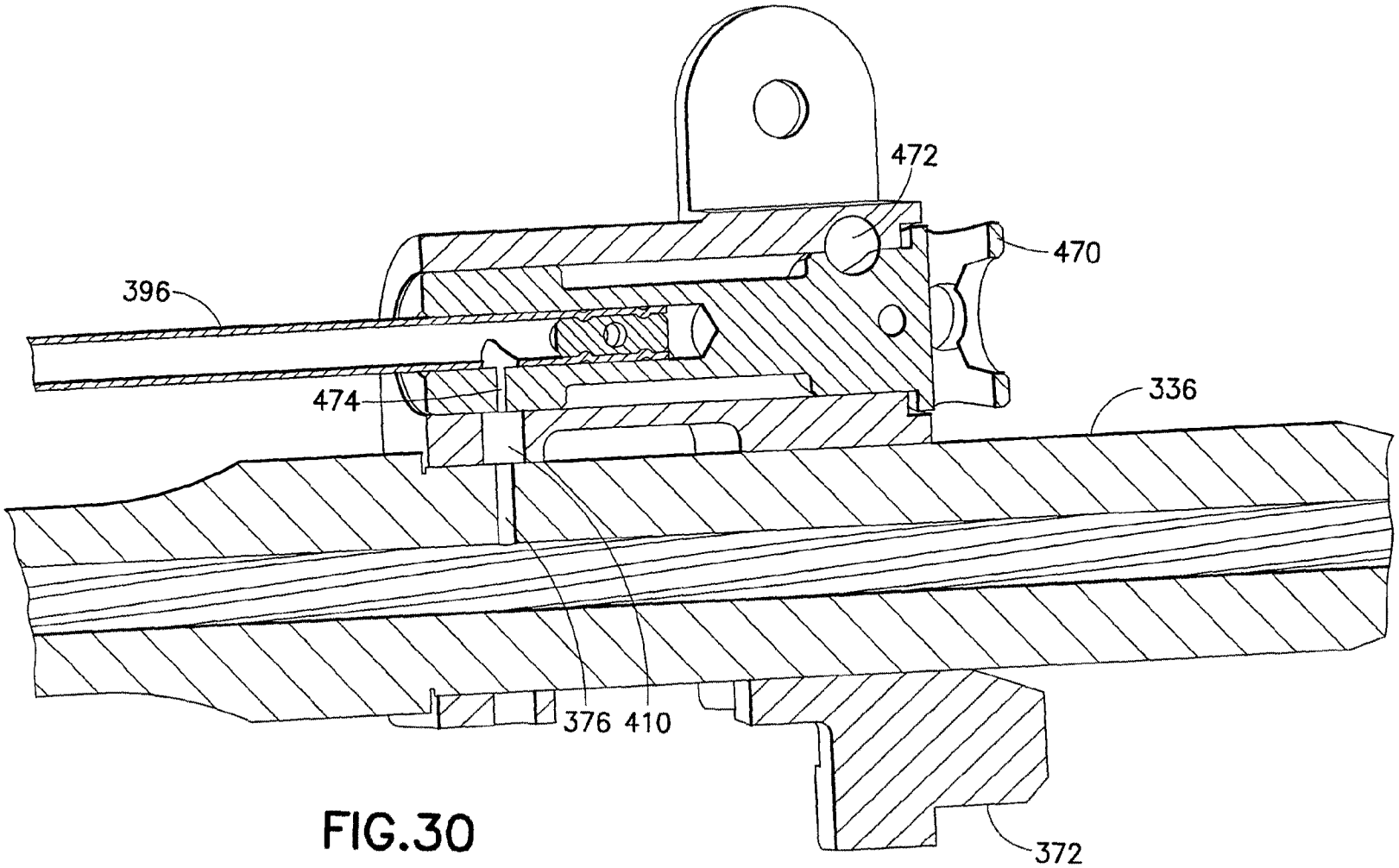
FIG. 30 is a section view of a barrel and gas tube assembly.
Figure 31:
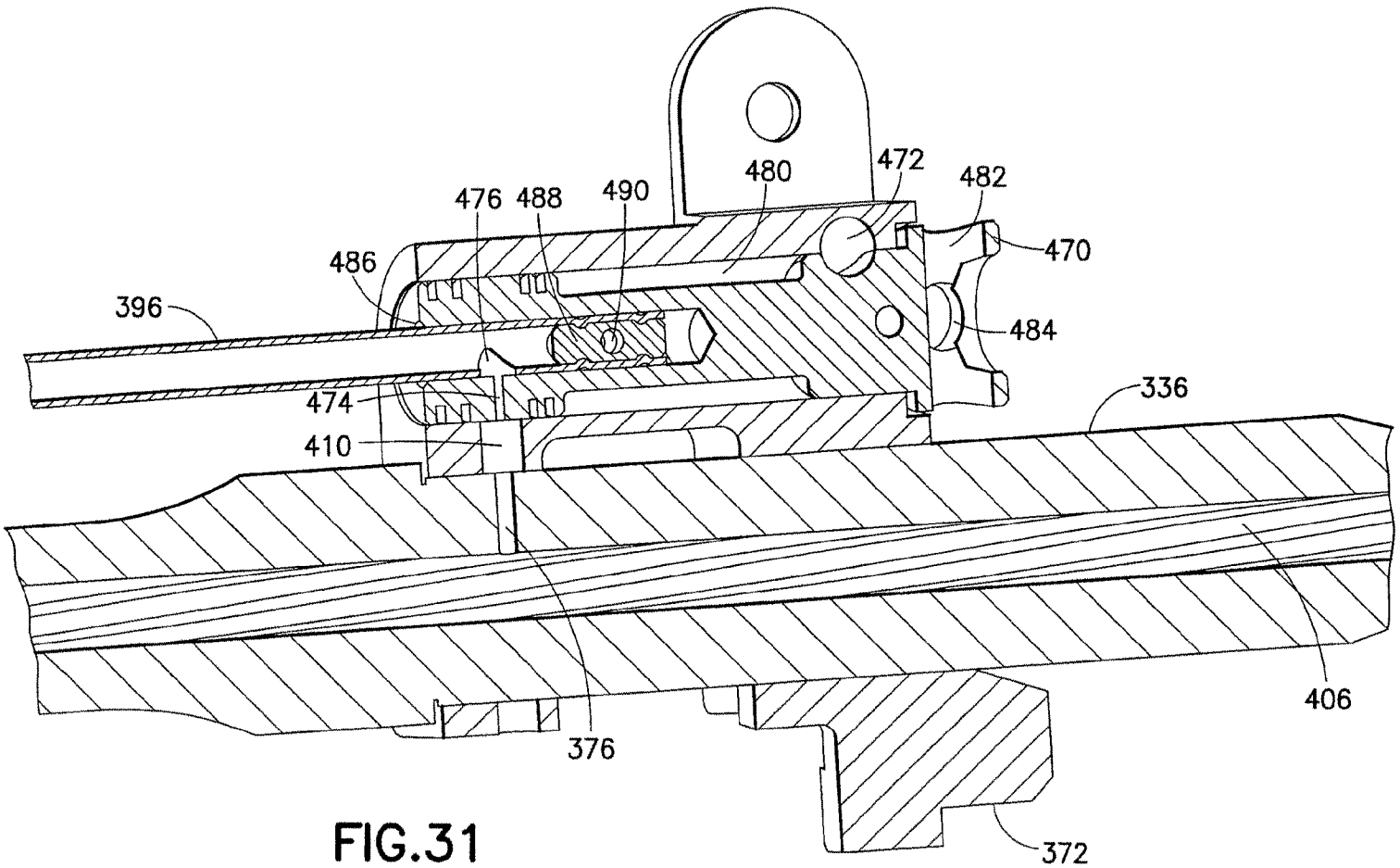
FIG. 31 is a section view of a barrel and gas tube assembly.

Referring now to FIG. 29, there is shown a section view of a barrel and gas tube assembly. Referring also to FIG. 30, there is shown a section view of a barrel and gas tube assembly. Referring also to FIG. 31, there is shown a section view of a barrel and gas tube assembly. The system 338 interfaces with gas block 372 fitted to barrel assembly 336 via gas line 396 and sleeve 470. Barrel 336 has bore 406 with the gas block being in fluid communication with the bore through a port 376 in barrel 336. The gas block may have a passage (extending through the gas block as shown and configured to receive gas sleeve 470) that is in fluid communication with the bore through a corresponding port 410 disposed on a surface of the gas block facing the barrel. The sleeve is in fluid communication with the bore through a gas regulation port 474 disposed on a surface of the sleeve facing the barrel. In the exemplary embodiment sleeve port 474 may have a smaller fluid flow opening than the port 410 of the gas bore. The tube 396 is in fluid communication with the bore through a corresponding port 476 disposed on a surface of the tube facing the barrel. Hence, cylinder housing 392 is in fluid communication with bore 406 via gas block 372, sleeve 470 and gas tube 396. In the exemplary embodiment, gas sleeve 470 defines a gas feed regulator, that may provide a desired gas feed flow volume or rate to the operating system independent of variances in the exhaust port 376 of the barrel. Different feed rates may be provided by interchanging gas sleeves (similar to sleeve 470) having different sized ports (similar to regulator port 474). The port size in different gas sleeves may be varied with for example barrel length, and desired gas sleeve may be selected to be installed into the gas block according to barrel length. Tube 396 may have a keyed feature (not shown) that prevents rotation of tube 396 relative of sleeve 470 during operation and alignment of the ports. In alternate embodiments, a recess may be made in the bore of sleeve 470 allowing rotation of tube 396. Holes 482, 484 may be provided on the head of sleeve 470 whereby a tool may be used to rotate sleeve 470 for removal in the event of carbon buildup preventing removal. Chamfer 486 is shown provided on the bore of sleeve 470 to allow for easy assembly and disassembly of red 396 to sleeve 470. A plug 488 having recesses is provided in tube 396 where the outer surface of tube 396 is formed over the recesses to retain the plug. A hole through tube 396 and plug 490 is shown for proper orientation. In the exemplary embodiment removable sleeve 470 is maintained captive with takedown pin 472 above the sleeve 470 engaging a slot in the upper portion of sleeve 470 that provides a cam surface for pin 472 to cam sleeve 470 to seal sleeve 470 opening to the gas port in the sight block. A wave spring may be provided under the head of sleeve 470 to bias cylinder 470 forward, removing play and actuating the cam surface by lock pin 472. The take down pin may be held captive. In alternate embodiments, the sleeve may also have exhaust ports. Relief 480 in the outside diameter of sleeve 470 may facilitate cutting gum or carbon and act as a scrapper and may also be relieved in the back to clear any carbon buildup.

Figure 32:
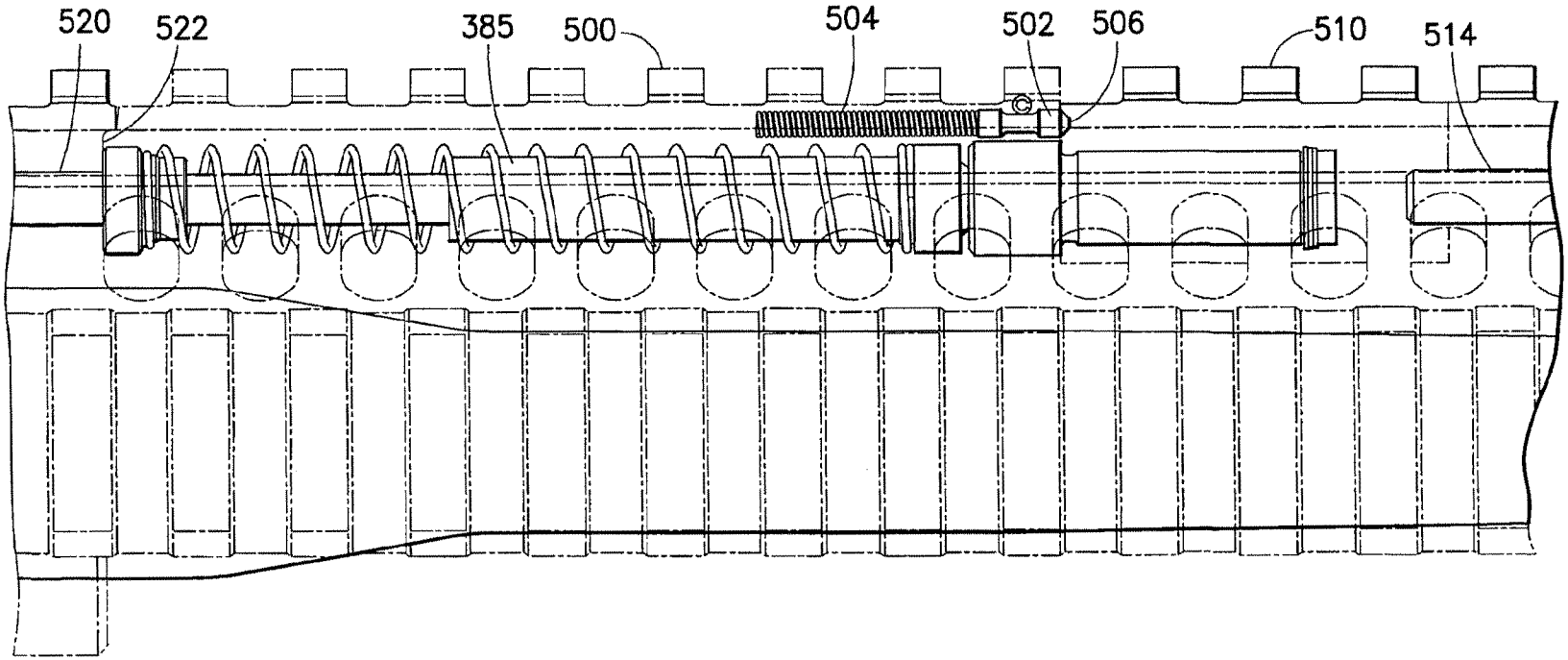
FIG. 32 is a section view of an upper receiver and handguard of a firearm having features in accordance with another exemplary embodiment.
Figure 33:
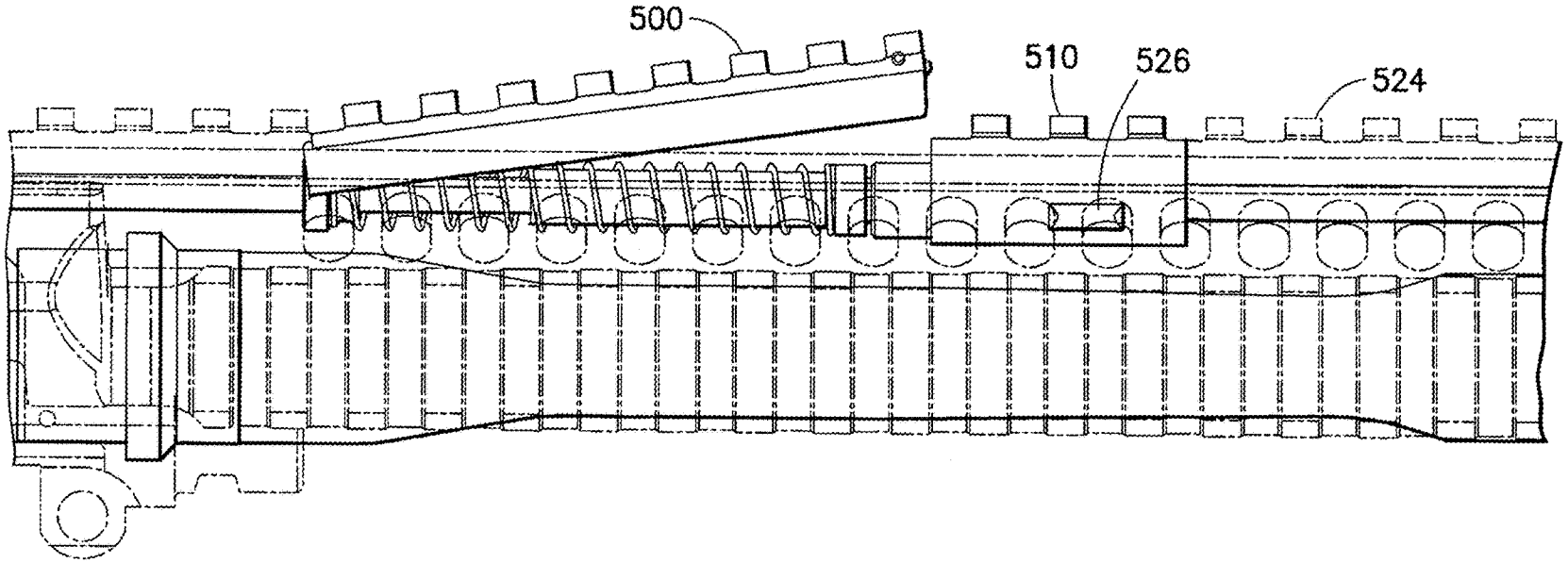
FIG. 33 is a section view of an upper receiver and handguard.
Figure 34:
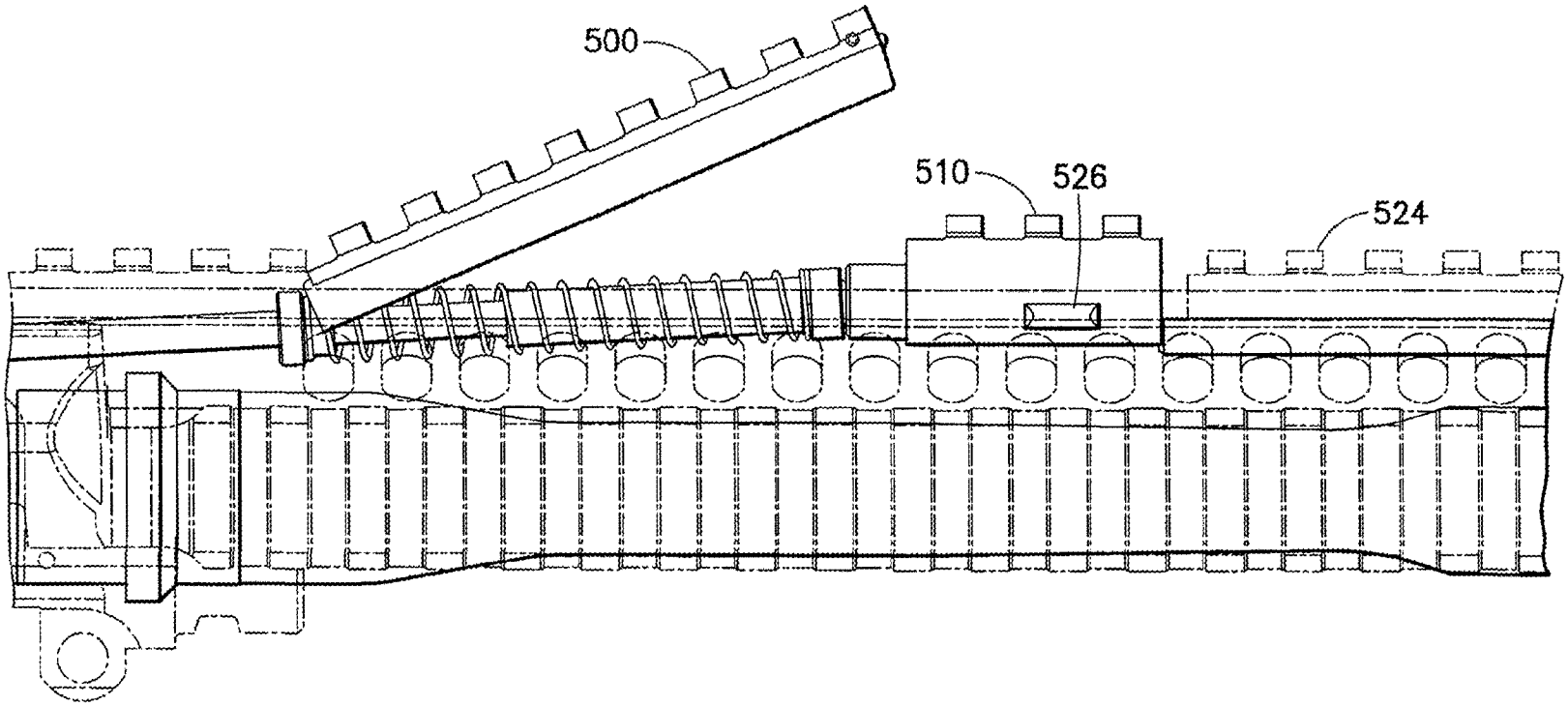
FIG. 34 is a section view of an upper receiver and handguard.

Referring now to FIG. 32, there is shown a section view of an upper receiver with hand guard and operating system in accordance with another exemplary embodiment. In the embodiment shown, access panel 500 is provided having detents 502 that are spring loaded by springs 504 to engage mating recess 506 of cylinder housing 510. As described above, cylinder housing 510 has cylinder 512 that mates with gas tube or line 514. In the exemplary embodiment, a single common gas line 514 feeds and exhaust gas from the cylinder. As described above, cylinder housing 510 has cylinder 512 that houses movable piston 516 that drives operating rod 520. In the embodiment shown, the removable portion 500 may be locked by detents 506 engaging the housing 510 and is positively held in place by shelf 522 (see also FIG. 33) that engages a mating portion under the upper rail of hand guard 524. In the embodiment shown, removable panel 500 may be removed for access to allow system removal without disconnecting the piston and the operating rod from each other. The operating system may be installed and removed as a unit in a manner similar to that previously described. Referring also to FIG. 33, there is shown a section view of an upper receiver and hand guard with the removable cover 500 slightly removed. Referring also to FIG. 34, there is shown a section view of an upper receiver and hand guard with the removable cover 500 slightly removed even more with the housing 510, piston 516 and operating rod 520 being removed as an assembly. Keys 526 are provided on housing 510 that mate with corresponding slots (not shown) in hand guard 524 capturing the housing 510 to the hand guard 524 when installed.

Figure 35:
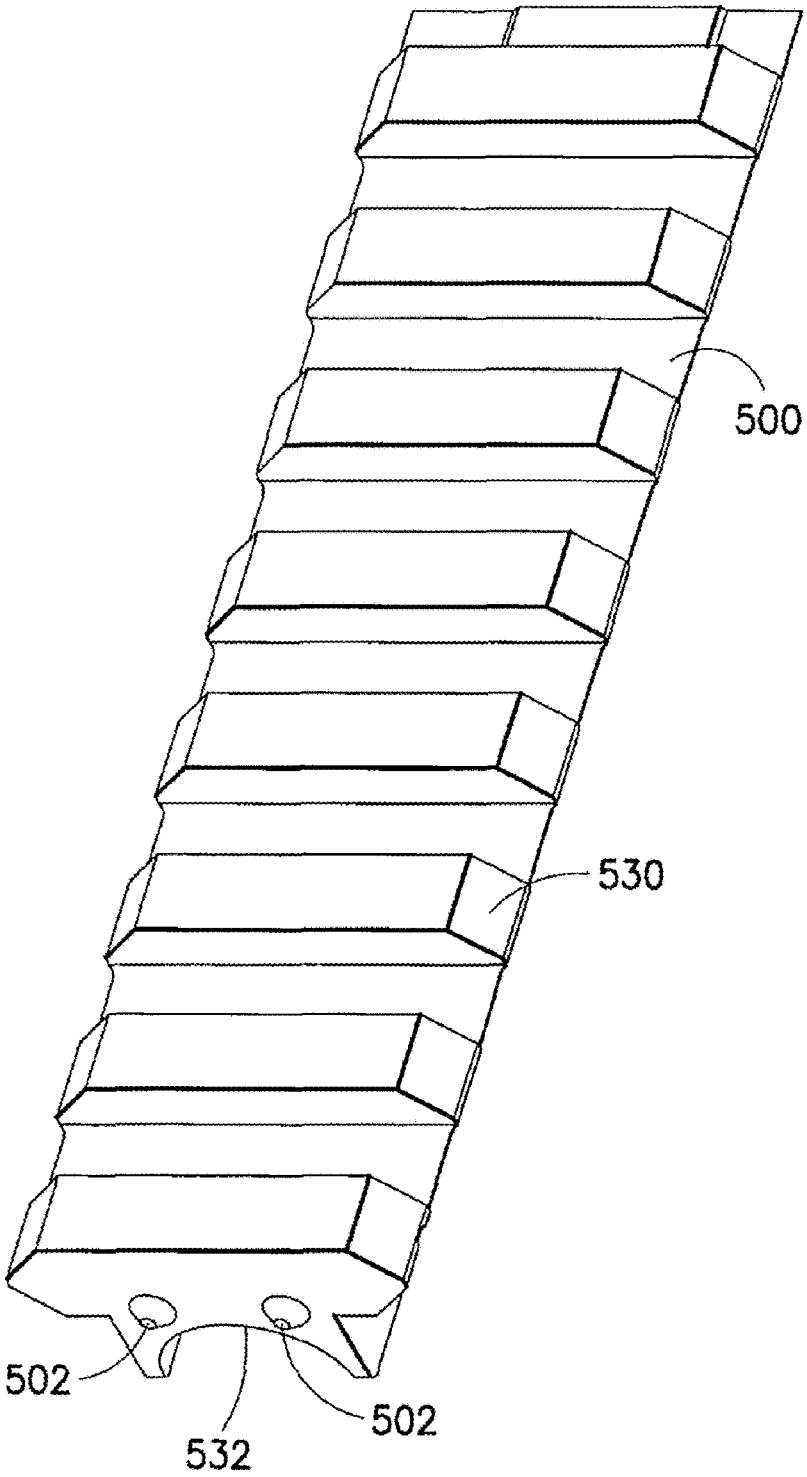
FIG. 35 is an isometric view of a cover.

Referring now to FIG. 35, there is shown an isometric view of a cover. In the embodiment shown, cover or access panel 500 is provided having detents 502 that are spring loaded to engage a mating recess 506 of cylinder housing 510. Rail 530 is provided to align with the upper rail of the hand guard. Recess 532 is provided to allow clearance to the operating rod assembly.

Figure 36:
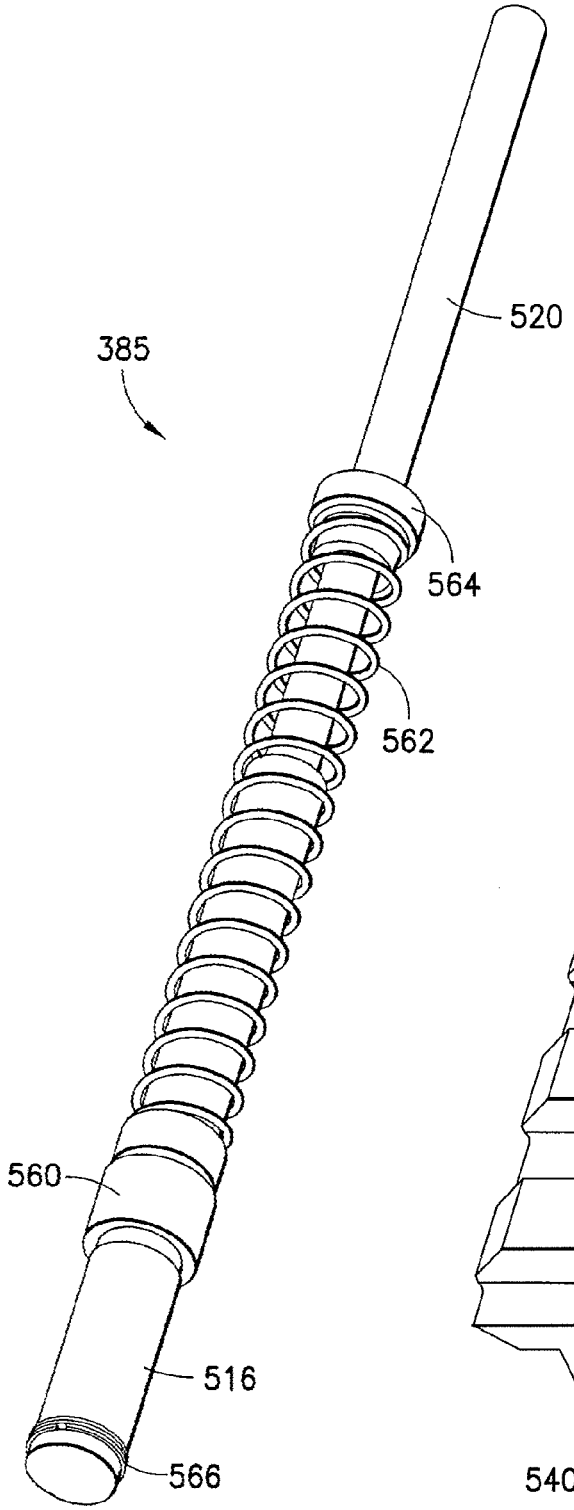
FIG. 36 is an isometric view of an operating rod assembly.

Referring now to FIG. 36, there is shown an isometric view of an operating rod assembly 385. Operating rod 385 may be an articulated or compliant operating rod having a piston end and a striking end. In the exemplary embodiment, the compliant operating rod may include articulating joint, that 560 may allow for example angular motion between the piston end and the striking end and may reduce the potential for misalignment and jamming of the operating system. The operating rod may also be configured to allow for removal of the operating rod from the piston. In the embodiment shown, the articulating joint may comprise a suitable socket joint that for example may have a ball shaped surface on the piston end portion of the fitting into a cuplike depression in the piston 516. The cuplike depression may have a slightly larger diameter than the ball shaped surface allowing the joint to be capable of motion around an indefinite number of axis with an essentially common center. A circlip or retaining ring (not shown) may be provided movable within a retaining groove cut within piston 516 allowing the rod to be maintained within the piston but removable with sufficient separation force where the ring retains the ball in the socket but allows removal with the application of sufficient force to deflect the ring outward. A relief is cut in end portion of rod 520 allowing the joint 460 to rotate without binding. In the exemplary embodiment, the operating rod 520 may be an assembly or a solid piece. The assembly 385 also includes spring 562 between a shoulder of rod 520 and a stop washer 564 to bias the rod 520 toward the cylinder housing where the stop washer abuts the receiver. Piston 516 has annular rings 566 that may form a seal and to minimize carbon build up.

Figure 37:
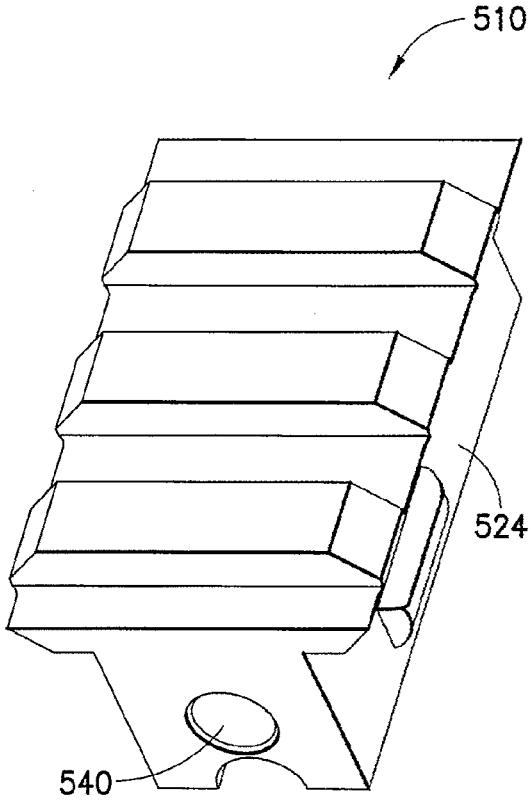
FIG. 37 is an isometric view of a piston housing.

Referring now to FIG. 37, there is shown an isometric view of a piston housing. Rail 530 is provided on housing 510 to align with the upper rail of the hand guard. Keys 526 are provided on housing 510 that mate with corresponding slots (not shown) in hand guard 524 capturing the housing 510 to the hand guard 524 when installed. Bore 540 is provided to interface the cylinder with the tube 514.

Figure 38:
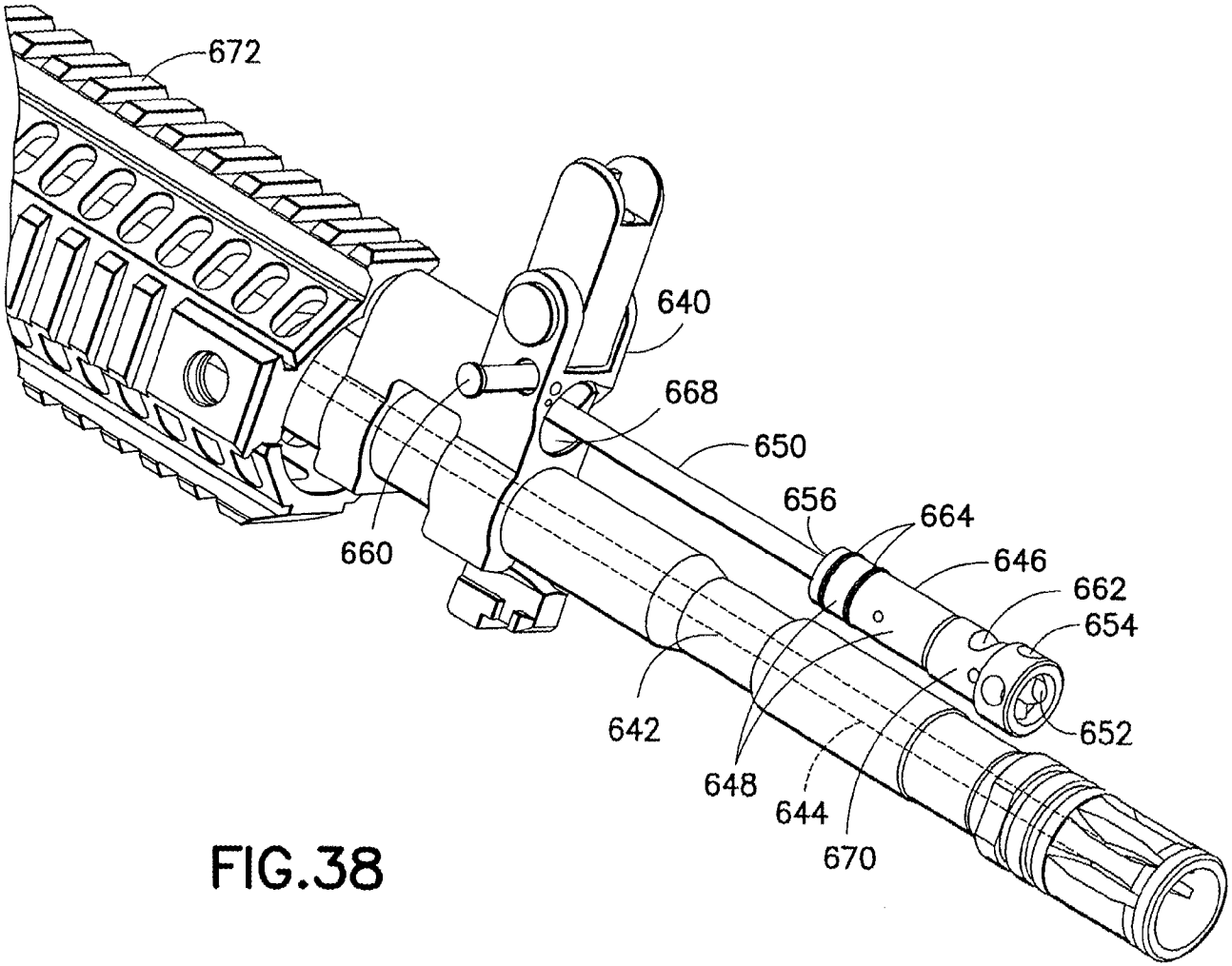
FIG. 38 is an exploded isometric view of a barrel and gas tube assembly.
Figure 39:
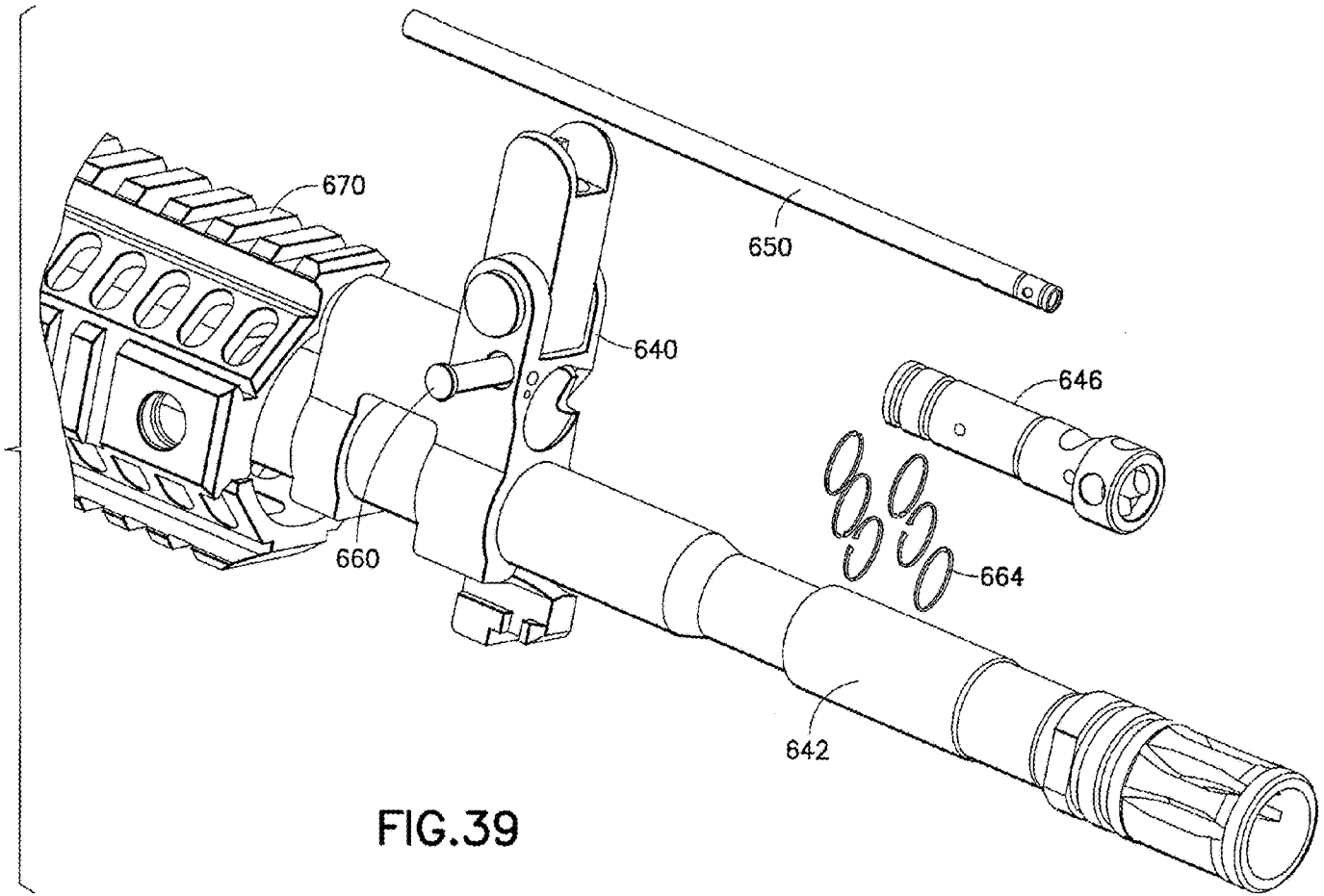
FIG. 39 is an exploded isometric view of a barrel and gas tube assembly.

Referring now to FIG. 38, there is shown an exploded isometric view of a barrel and gas tube assembly in accordance with another exemplary embodiment. Referring also to FIG. 39, there is also shown an exploded isometric view of a barrel and gas tube assembly. Gas block 640 is shown fitted to barrel assembly 642. Barrel 642 has bore 644 with the gas block being in fluid communication with the bore through a port in barrel 642. The gas block is in fluid communication with the bore through a corresponding port disposed on a surface of the gas block facing the barrel. Sleeve 646 is in fluid communication with the bore through a gas regulation port 648 disposed on a surface of the sleeve facing the barrel. Tube 650 is in fluid communication with the bore through a corresponding port disposed on a surface of the tube facing the barrel. Hence, tube 650 is in fluid communication with bore 644 via gas block 640 and sleeve 646. In the exemplary embodiment, gas sleeve 646 defines a gas feed regulator, that may provide a desired gas feed flow to the operating system independent of variances in the exhaust port of the barrel. Different feed rates may be provided by interchanging gas sleeves (similar to sleeve 646) having different sized ports (similar to regulator port 648). The port size in different gas sleeves may be varied with for example barrel length, and desired gas sleeve may be selected to be installed into the gas block according to barrel length. Holes 652, 654 may be provided on the head of sleeve 646 whereby a tool may be used to rotate sleeve 646 for removal in the event of carbon buildup preventing removal. Chamfer 656 is shown provided on the bore of sleeve 470 to allow for easy assembly and disassembly of sleeve 646. In the exemplary embodiment removable sleeve 646 is maintained captive with takedown pin 660 above the sleeve 646 engaging a slot 662 in the upper portion of sleeve 646 that provides a cam surface for pin 660 to cam sleeve 646 to seal sleeve 646 opening to the gas port in the sight block. A wave spring may be provided under the head of sleeve 646 to bias sleeve 646 forward, removing play and actuating the cam surface by lock pin 660. The take down pin may be held captive. In alternate embodiments, the sleeve may also have exhaust ports. Rings 664 may be provided in grooves in the outside diameter of sleeve 646 on either side of port 648 may facilitate sealing and cutting gum or carbon and act as a scrapper and may also be relieved in the back to clear any carbon buildup upon removal of sleeve 646. The bore 668 of block 640 and/or the outside diameter 670 of sleeve 646 may be tapered to better facilitate sealing of rings 664 to bore 668. In the exemplary embodiment, three rings 664 are shown on either side of port 648. In alternate embodiments, more or less rings may be provided.

Figure 40:
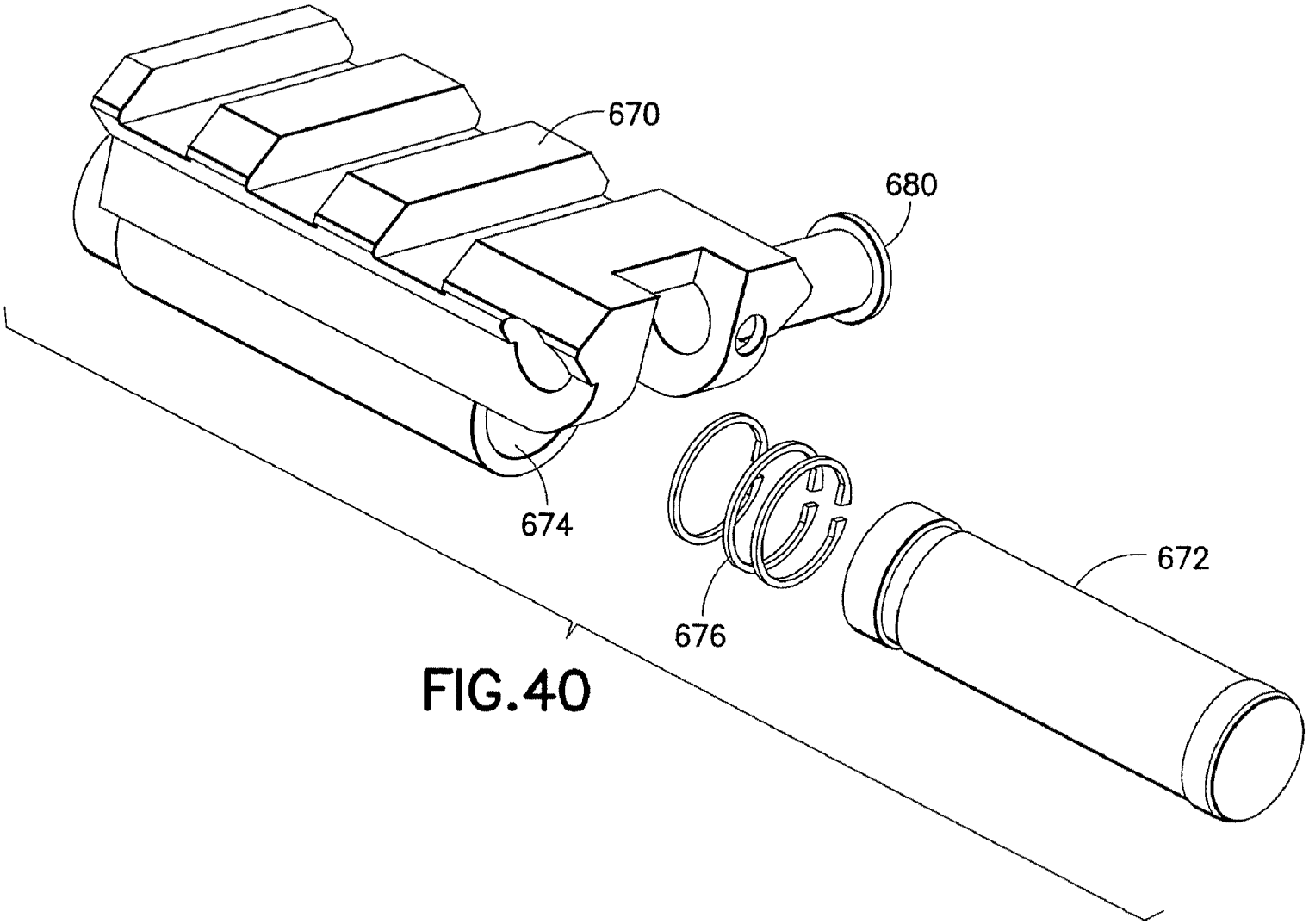
FIG. 40 is an exploded isometric view of a portion of an indirect gas operating system of a firearm having features in accordance with another exemplary embodiment showing a piston housing and piston assembly of the operating system.

Referring now to FIG. 40, there is shown an exploded isometric view of a piston housing 670 and piston 672 assembly in accordance with another exemplary embodiment. In the embodiment shown, housing 670 except as otherwise described below, may be substantially similar to housing 392 and may be mounted to the receiver 672 (or integral handguard) providing an indirect gas operating system mounted with a mounting structure connected to the receiver so that the operating system is dependent from the receiver and is substantially independent of the barrel. In the exemplary embodiment, the indirect gas operating system and the barrel are separately and independently mounted to the receiver so that the indirect gas operating system and barrel are structural independent from each other with the indirect gas operating system coupled to the receiver independent of the barrel. Housing 670 has cylinder 674 that interfaces to a gas block 640 fitted to barrel assembly 642. Here, cylinder housing 670 is remote from the gas block 640, and is in fluid communication with gas block 640 via gas tube 650. Piston 672 may be provided with rings 676 in grooves in the outside diameter of piston 672 that may facilitate sealing and cutting gum or carbon and act as a scrapper and may also be relieved in the back to clear any carbon buildup. Pin 680 is provided to couple housing 670 to receiver 672. In the exemplary embodiment, cylinder housing 670 and piston 672 are housed within the hand guard portion 672 of the upper receiver. As such, cylinder housing 670 is mounted to hand guard portion 672 and removable from hand guard portion 672 for cleaning. Removal of cylinder housing 670 may be effected by removal of pin 680. Piston 672 interfaces directly with the striking surface of the bolt carrier and maintains parallel alignment with bolt carrier 364. Here, the cylinder housing, piston and operating rod module is independent of and decoupled from the barrel and mounted to the upper receiver shifted forward and away from the chamber. When a cartridge is fired, pressurized gas enters gas block 640, passes to the cylinder 674 within cylinder housing 670 via gas tube 650, displaces piston 672 and causes piston 672 to strike striking surface of the bolt assembly.

Figure 41:
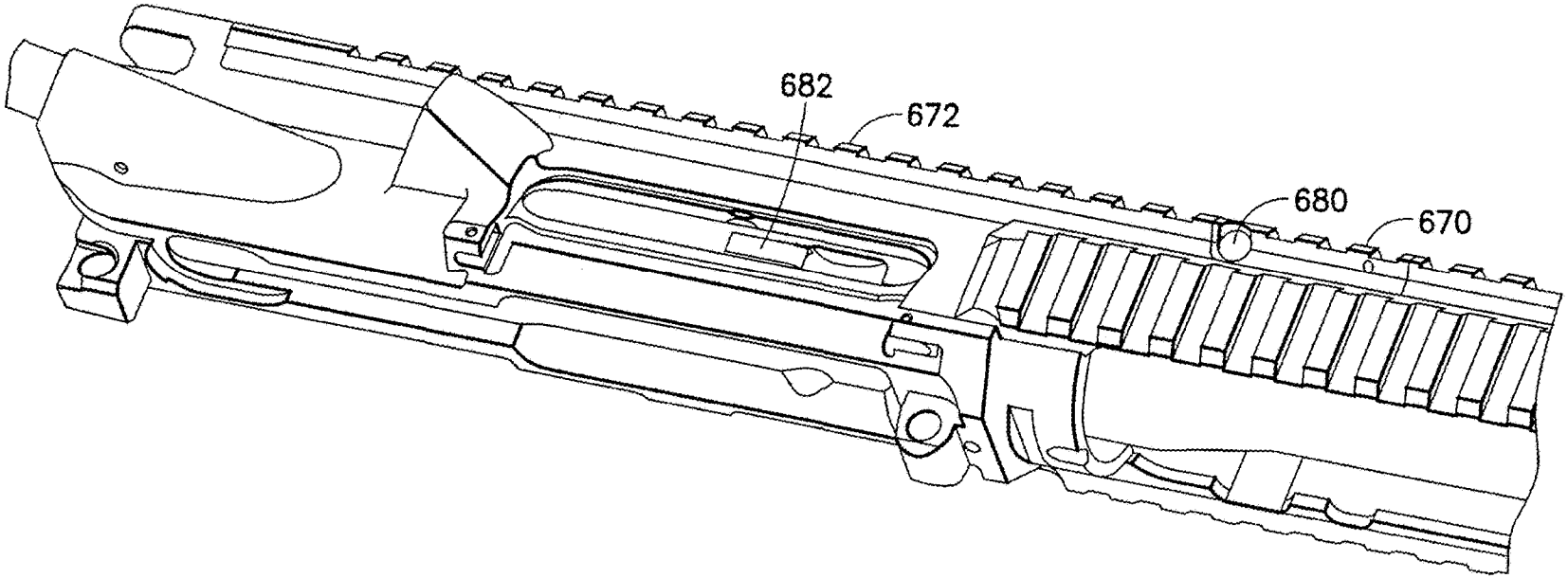
FIG. 41 is a cutaway isometric view of an upper receiver assembly of a firearm having features according to another exemplary embodiment.
Figure 42:
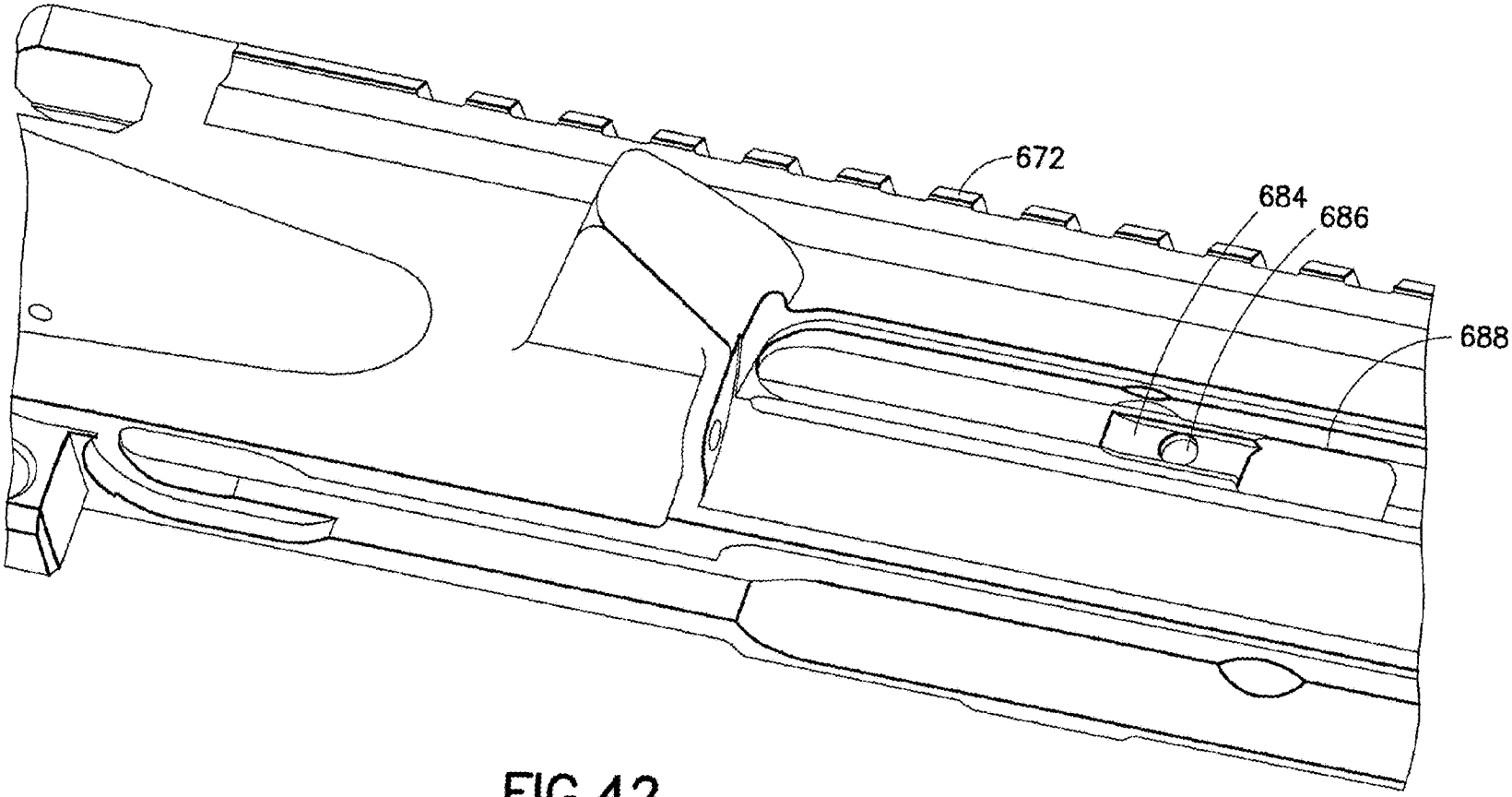
FIG. 42 is an isometric view of an upper receiver assembly.
Figure 43:
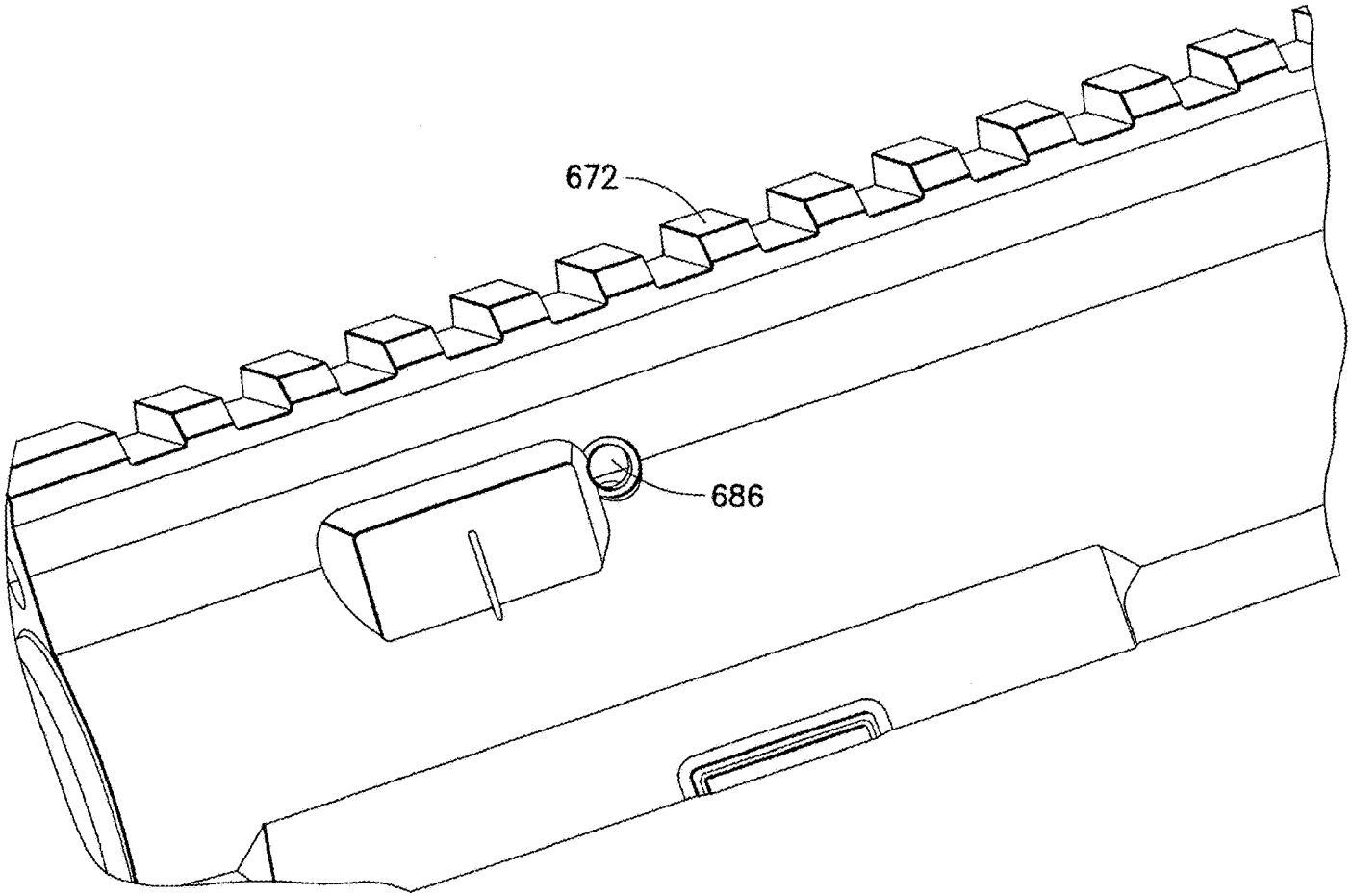
FIG. 43 is an isometric view of an upper receiver assembly.

Referring now to FIG. 41, there is shown an isometric view of an upper receiver assembly 672. Referring also to FIG. 42, there is shown an isometric view of an upper receiver assembly 672. Referring also to FIG. 43, there is shown an isometric view of an upper receiver assembly 672. Cam pin plate 682 is shown removably mounted to upper receiver 672 in recess 684. In the exemplary embodiment, a screw (not shown) may fasten cam pin plate 682 to upper receiver 672 in recess 684 through hole 686 in receiver 672. In alternate embodiments the cam pin plate may be fastened to the receiver with any other suitable fastening system including for example, pinning, fitting, staking, or bonding. Cam pin 606 (see also FIGS. 14 and 45) may contact cam pin plate 682 when the bolt is in the firing position and rotates away when fired. As may be realized, in the exemplary embodiment, the cam pin plate 682 may be made from a different material than the receiver for example, cam pin plate 682 may be made from steel or aluminum or any other suitable material including non-metallic such as ceramic or plastic and is provided to eliminate the cam pin from wearing the receiver 672 during use. In the exemplary embodiment, a recess 688 may be provided in upper receiver assembly 672 to provide a stable seating for cam pin plate 682 to eliminate possible relative movement between cam pin plate and receiver 672 during use.

Figure 44:
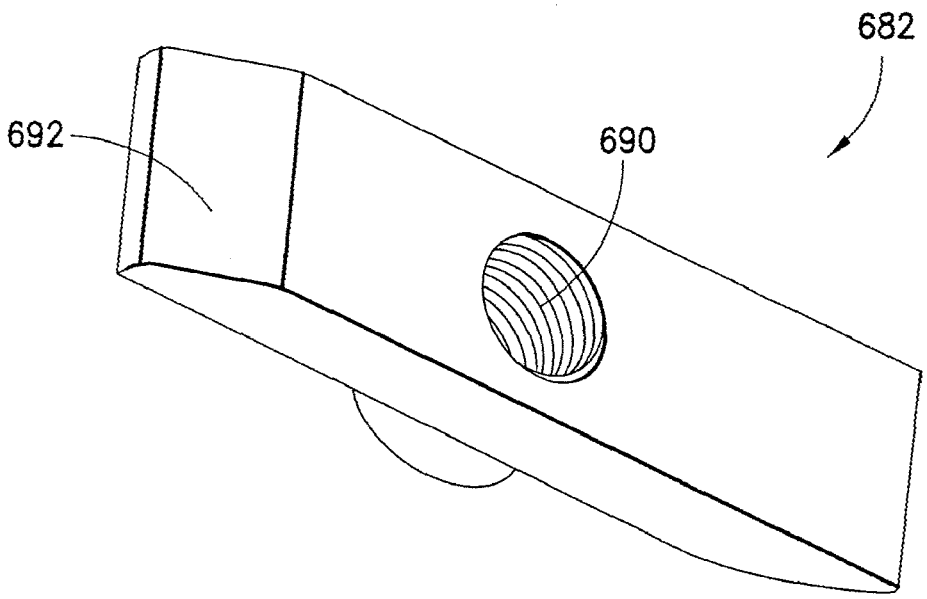
FIG. 44 is an isometric view of a cam pin plate.

Referring now to FIG. 44, there is shown an isometric view of a cam pin plate 682. Cam pin plate 682 is shown having threads 690 for fastening cam pin plate 682 to receiver 672. Tapered, ramped or described lead edge 692 is provided to prevent jamming or interference between cam pin 606 and cam pin plate 682.

Figure 45:
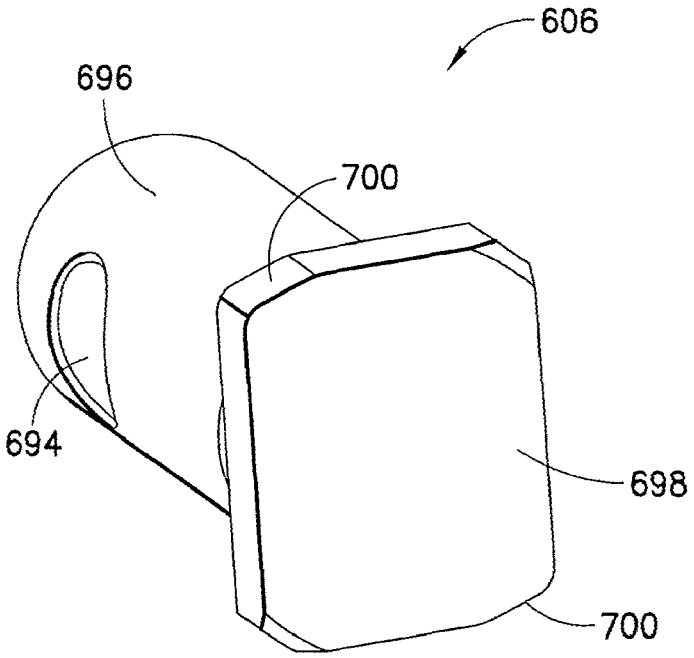
FIG. 45 is an isometric view of a cam pin.

Referring now to FIG. 45, there is shown an isometric view of a cam pin 606. Cam pin 606 has bore 694 where the firing pin through bore 694 retains cam pin 606 too the bolt. Cam pin 606 has a rounded outside cam section 696 and top plate 698 with guide surfaces that may engage the cam pin plate in the receiver. In the exemplary embodiment, top plate 698 has lead in chamfers 700 shown to be about twenty degree chamfers. The lead in chamfers present a shallower contact angle with the contact surfaces of the receiver or with the cam pin plate 682, in the event of any rotation between cam pin 606 and receiver, to minimize or distribute contact forces and reduce wear to the receiver in the event of contact such as for example when the operating rod strokes the striking surface of the bolt carrier as described before. In alternate embodiments, any suitable angle may be provided.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An automatic or semi-automatic rifle comprising:

a receiver;

a bolt assembly having a striking surface, the bolt assembly housed within the receiver;

a barrel having a bore, the barrel coupled to the receiver; and an indirect gas operating system having a cylinder and a piston, wherein the cylinder and the piston are structurally coupled to the receiver and structurally decoupled from the barrel;

wherein, the cylinder is in fluid communication with the bore, and wherein, the piston is fitted to the cylinder and disposed for striking the striking surface and displacing the bolt assembly and wherein the cylinder is isolated from deflection of the barrel, wherein the piston has a piston portion and an operating rod portion, the operating rod portion disposed for striking the striking surface and displacing the bolt assembly and wherein the operating rod has an articulating joint on a piston end of the operating rod that is received within the piston and wherein the articulating joint provides angular motion between the piston end and a striking end of the operating rod.

2. The automatic or semi-automatic rifle of claim 1, wherein the operating rod portion and striking surface disengage each other after the operating rod portion strikes the striking surface.

3. The automatic or semi-automatic rifle of claim 1 further comprising a hand guard coupled to the receiver, wherein the cylinder and the piston are mounted to the hand guard.

4. The automatic or semi-automatic rifle of claim 1, wherein the receiver has an integral hand guard portion, and wherein the cylinder and piston are mounted to the integral hand guard portion.

5. An automatic or semi-automatic rifle comprising:

a receiver;

a bolt assembly having a striking surface, the bolt assembly housed within the receiver;

a barrel having a bore, the barrel coupled to the receiver; and an indirect gas operating system having a cylinder and a piston, the cylinder and the piston are structurally coupled to the receiver and structurally decoupled from the barrel;

wherein, the cylinder is in fluid communication with the bore through a gas tube and wherein, the piston is fitted to the cylinder and disposed for striking the striking surface and displacing the bolt assembly and wherein the cylinder is isolated from deflection of the barrel, wherein the piston has a piston portion and an operating rod portion, the operating rod portion disposed for striking the striking surface and displacing the bolt assembly and wherein the operating rod has an articulating joint on a piston end of the operating rod that is received within the piston and wherein the articulating joint provides angular motion between the piston end and a striking end of the operating rod.

6. An automatic or semi-automatic rifle comprising:

a receiver;

a bolt assembly having a striking surface, the bolt assembly housed within the receiver;

a barrel having a bore, the barrel coupled to the receiver; and an indirect gas operating system having a cylinder and a piston, wherein the cylinder and the piston are structurally coupled to the receiver and structurally decoupled from the barrel;

wherein, the cylinder is in fluid communication with the bore, and wherein, the piston is fitted to the cylinder and disposed for striking the striking surface and displacing the bolt assembly and wherein the cylinder is isolated from deflection of the barrel, wherein the receiver has a hand guard portion and the cylinder is formed in a mounting structure removably secured to the hand guard portion and the piston is slidably received within the cylinder and wherein the mounting structure comprises a portion of a rail of the hand guard portion.

7. The automatic or semi-automatic rifle of claim 6, wherein the bolt assembly comprises a bolt carrier and an operating rod, and wherein the operating rod has an end portion comprising the striking surface.

8. The automatic or semi-automatic rifle of claim 1, wherein the barrel has a forward end and a rearward end, wherein only the rearward end is directly secured to the receiver.

* * * * *